US011320094B2

(12) United States Patent
Choi et al.

(10) Patent No.: US 11,320,094 B2
(45) Date of Patent: May 3, 2022

(54) SYSTEM FOR AUTOMATICALLY REPLACING HIGH-PRESSURE GAS TANK AND METHOD THEREOF

(71) Applicant: AMT CO., LTD., Asan-si (KR)

(72) Inventors: Won Ho Choi, Cheonan-si (KR); Chan Woo Kim, Anyang-si (KR)

(73) Assignee: AMT CO., LTD., Asan-si (KR)

( * ) Notice: Subject to any disclaimer, the term of this patent is extended or adjusted under 35 U.S.C. 154(b) by 163 days.

(21) Appl. No.: 16/652,257

(22) PCT Filed: Nov. 14, 2018

(86) PCT No.: PCT/KR2018/013860

§ 371 (c)(1),
(2) Date: Mar. 30, 2020

(87) PCT Pub. No.: WO2020/075904

PCT Pub. Date: Apr. 16, 2020

(65) Prior Publication Data

US 2021/0222834 A1 Jul. 22, 2021

(30) Foreign Application Priority Data

Oct. 11, 2018 (KR) ..... 10-2018-0121300

(51) Int. Cl.
*F17C 13/04* (2006.01)
*F17C 13/12* (2006.01)
*F17C 13/08* (2006.01)

(52) U.S. Cl.
CPC ..... *F17C 13/04* (2013.01); *F17C 13/12* (2013.01); *F17C 13/084* (2013.01);
(Continued)

(58) Field of Classification Search
CPC .. Y10T 137/4857; F17C 13/045; F17C 13/04; F17C 13/12; F17C 13/084;
(Continued)

(56) References Cited

U.S. PATENT DOCUMENTS 3,708,854 A * 1/1973 Nalbach ..... B21D 51/2661 29/809
4,856,565 A * 8/1989 Schoeffl ..... F17C 13/084 141/97

(Continued)

FOREIGN PATENT DOCUMENTS

DE 2028634 A1 * 12/1970 ..... F17C 5/005
EP 0660026 A1 * 6/1995 ..... F17C 5/005

(Continued)

OTHER PUBLICATIONS

Translation from espacenet.com of JPH06265100A retrieved Nov. 2021. (Year: 2021).*

(Continued)

*Primary Examiner* — Jessica Cahill
(74) *Attorney, Agent, or Firm* — Paratus Law Group, PLLC

(57) ABSTRACT

Disclosed is system for automatically replacing a high-pressure gas tank, including: a high-pressure gas tank lift installed in a cabinet which is able to be elevated and including a die to load a high-pressure gas tank thereon; a high-pressure gas tank clamp clamping the high-pressure gas tank loaded on the die of the high-pressure gas tank lift to align the position of the high-pressure gas tank; a high-pressure gas tank connection unit removing an end cap from the high-pressure gas tank elevated by the high-pressure gas tank lift to automatically connect a connector holder to a gas injection nozzle and control the flow of gas; and control unit installed in the cabinet to control operation of the high-pressure gas tank connection unit, the high-pressure gas tank lift, and the high-pressure gas tank clamp.

15 Claims, 19 Drawing Sheets

(52) U.S. Cl.
CPC ..... *F17C 2201/0104* (2013.01); *F17C 2205/0332* (2013.01); *F17C 2205/0382* (2013.01); *F17C 2223/0123* (2013.01); *F17C 2270/0518* (2013.01)

(58) Field of Classification Search
CPC ..... F17C 2201/0104; F17C 2205/0332; F17C 2205/0382; F17C 2205/0123; F17C 2223/0123; F17C 2270/0518
See application file for complete search history.

(56) References Cited

U.S. PATENT DOCUMENTS 5,465,766 A * 11/1995 Siegele ..... B01J 4/00 137/209
6,012,478 A * 1/2000 Park ..... F17C 13/04 137/240
6,260,588 B1 * 7/2001 Noah ..... B01J 4/00 137/377
6,698,469 B2 * 3/2004 Sakamoto ..... F17C 13/04 141/91
9,044,835 B2 * 6/2015 Masuda ..... B23P 19/065

FOREIGN PATENT DOCUMENTS

JP H05172300 A * 5/1993
JP H06265100 A * 6/1994
JP H0791598 A * 7/1995
KR 10-0242982 B1 2/2000
KR 10-0649112 B1 11/2006
KR 100846670 B1 * 7/2008
KR 10-0985575 B1 10/2010

OTHER PUBLICATIONS

Translation from espacenet.com of KR100846670B1 retrieved Nov. 2021. (Year: 2021).*
Translation from espacenet.com of JPH05172300A retrieved Nov. 2021. (Year: 2021).*

* cited by examiner

SYSTEM FOR AUTOMATICALLY REPLACING HIGH-PRESSURE GAS TANK AND METHOD THEREOF

CROSS-REFERENCE TO PRIOR APPLICATIONS

This Application is a National Stage Patent Application of PCT International Patent Application No. PCT/KR2018/013860 (filed on Nov. 14, 2018) under 35 U.S.C. § 371, which claims priority to Korean Patent Application No. 10-2018-0121300 (filed on Oct. 11, 2018), which are all hereby incorporated by reference in their entirety.

BACKGROUND

The present invention relates to a system for automatically replacing a high-pressure gas tank, which automatically replaces a high-pressure gas tank loaded in and unloaded from a cabinet to supply gas to a wafer manufacturing line in a semiconductor fabrication facility, and a method thereof. According to the present invention, only when a high-pressure gas tank comes in contact with a high-pressure gas tank lift, the high-pressure gas tank is automatically connected to a high-pressure gas tank connection unit. When a predetermined amount of gas in the high-pressure gas tank is consumed, the high-pressure gas tank is automatically separated from the high-pressure gas tank connection unit to be unloaded.

In general, various types of gases are supplied and used in the manufacturing process of semiconductors. Since these gases mostly cause great damages such as safety accidents and environmental pollution when inhaled by the human body or exposed to the air, it is required to take careful attention to the gases.

For example, the gas used in the ion implantation process includes a fluid gas such as arsenic hydride (AsH3: Arsine), hydrogen phosphide (PH3: Phosphine) or boron trifluoride (BF3: Boron Fluoride), wherein since these gases are very toxic and can cause fatal effects if inhaled by workers into the respiratory system, careful management should be taken to prevent leakage during the supply thereof to the production line.

The gas used in the semiconductor manufacturing process is very important in the management thereof. The gas is filled at high pressure in a gas cylinder hereinafter, referred to as a "high-pressure gas tank" and the high-pressure gas tank is mounted in a cabinet such that the gas is supplied to the production line through a gas supply line. When about 90% of the gas is exhausted, a worker continues to supply the gas by replacing the high-pressure gas tank with a new one so that foreign matters remaining in the previous high-pressure gas tank is not supplied to the wafer processing process.

FIG. 1 is a perspective view schematically showing a gas supply device for semiconductor equipment according to the prior art. A cabinet 1 is positioned at a predetermined position outside a FAB 7 so as to load a plurality of high-pressure gas tanks (not illustrated), which are respectively filled with process gases such as SiH4, PH3, NF3, CF4, etc. required for the various equipment 8 inside the FAB 7, and a duct 4 is provided at one side of the cabinet 1 so as to guide gas supply lines 3 respectively connected to the high-pressure gas tanks.

The number of regulator boxes 5 corresponding to the number of the high-pressure gas tanks are provided at the other side of the duct 4 so as to supply the process gases introduced along the gas supply lines 3, and the same number of supply pipes 9 as the number of the equipment 8 are connected to the upper ends of the respective regulator boxes 5 so that the supply pipes 9 can be connected correspondingly to the equipment 8 in the FAB 7.

Therefore, when the process gas is supplied from each of the high-pressure gas tanks loaded in the cabinet 1, each process gas is introduced into each of the regulator boxes 5 along each of the gas supply lines 3 passing through the inside of the duct 4.

Thereafter, each process gas introduced into each regulator box 5 is purified through a filter (not illustrated) and then supplied flowing through each of the supply pipes 9, which are branched into the number corresponding to the number of the equipment 8 in the FAB 7 and thus connected thereto correspondingly, such that wafers can be processed.

If the gas is exhausted in the process of supply through the gas supply line 3 as described above and thus the replacement time of the high-pressure gas tank is detected by a control unit (not illustrated), the valve of the high-pressure gas tank used by the worker is closed and then separated from the external gas line thereof.

Then, the worker unloads the high-pressure gas tank, which has been separated from the gas line, from the cabinet 1 and replaces it with a new high-pressure gas tank. After that, the worker connects the new high-pressure gas tank to the external gas line again and then opens a valve handle, which has closed a gas injection nozzle, thereby finishing the replacement of the high-pressure gas tanks.

Prior Art Documents

[Patent Document 0001] Korean Reg. Patent Publication No. 10-0242982 (Reg. on 15 Nov. 1998)

[Patent Document 0002] Korean Reg. Patent Publication No. 10-0649112 (Reg. on 16 Nov. 2006) [Patent Document 0003] Korean Reg. Patent Publication No. 10-0985575 (Reg. on 29 Sep. 2010)

SUMMARY

However, this conventional high-pressure gas tank replacement method has a number of problems as follows.

First, although the used high-pressure gas tank must be replaced quickly such that the supply of gas through the gas line is not interrupted, the worker transports and replaces the heavy high-pressure gas tank of the weight by using a bogie such that the high-pressure gas tank is not able to be replaced quickly and the worker's fatigue is increased.

Second, whenever the gas was exhausted from the high-pressure gas tank loaded in the cabinet, the worker manually replaces the high-pressure gas tank such that human errors have been generated according to the skill of the worker.

Third, if the gas leaks inadvertently from the high-pressure gas tank due to carelessness while the worker transports or replaces the high-pressure gas tank, there is a fatal defect, in which the gas explodes or the operator becomes addicted to the leaked gas.

The present invention has been made to solve the above problems in the prior art and has an objective to implement a system capable of automatic replacement of high-pressure gas tanks in semiconductor fabrication facilities, in which a high-pressure gas tank is securely connected to a high-pressure gas tank connection unit by simply loading the high-pressure gas tank into a high-pressure gas tank lift in a cabinet as well as the high-pressure gas tank can be safely separated from the high-pressure gas tank connection unit when the gas in the high-pressure gas tank is exhausted.

The present invention has another objective to allow high-pressure gas tanks to be replaced automatically, thereby achieving the rapid replacement of the high-pressure gas tanks as well as reducing the fatigue of workers.

The present invention has a further objective to prevent the occurrence of safety accidents due to inadvertent leakage of gas from the high-pressure gas tank when replacing the high-pressure gas tank.

According to one aspect of the present invention, in order to achieve the above objectives, there is provided a system for automatically replacing a high-pressure gas tank, including a high-pressure gas tank lift installed in a cabinet so as to be elevated and including a die to load a high-pressure gas tank thereon, a high-pressure gas tank clamp for clamping the high-pressure gas tank loaded on the die of the high-pressure gas tank lift and then aligning the position of the high-pressure gas tank, a high-pressure gas tank connection unit for removing an end cap from the high-pressure gas tank elevated by the high-pressure gas tank lift and then automatically connecting a connector holder to a gas injection nozzle so as to control the flow of a gas, and a control unit installed in the cabinet so as to control the driving of the high-pressure gas tank connection unit, the high-pressure gas tank lift, and the high-pressure gas tank clamp.

According to another aspect of the present invention, there is provided a method for automatically replacing a high-pressure gas tank, including the step of closing a valve handle by means of a valve handle unit if a control unit detects the weight of a high-pressure gas tank and determines the replacement time of a high-pressure gas tank, the step of separating a connector holder connected to a gas injection nozzle by means of a high-pressure gas tank connection unit, and then closing the gas injection nozzle with an end cap, the step of lowering the high-pressure gas tank lift to a bottom dead point and then opening a high-pressure gas tank clamp from the high-pressure gas tank and removing the used high-pressure gas tank from a die, the step of placing a new high-pressure gas tank on the die and then, after clamping the new high-pressure gas tank with the high-pressure gas tank clamp, lifting the high-pressure gas tank to a top dead center, the step of aligning the position of the high-pressure gas tank by using an auto coupler unit and the high-pressure gas tank clamp after the high-pressure gas tank is lifted up to the top dead center, the step of removing the end cap from the gas injection nozzle of the high-pressure gas tank and then connecting the gas injection nozzle to the connector holder, after the alignment of the high-pressure gas tank is finished, and the step of supplying gas through a gas pipe by rotating the valve handle by the operation of the valve handle unit.

The present invention has several advantages over the prior art.

First, by simply loading a high-pressure gas tank filled with toxic gas on a high-pressure gas tank lift, it is possible to automate the replacement of the toxic gas filled high-pressure gas tank, thereby safely replacing the high-pressure gas tank and saving expensive labor costs.

Second, the end cap is stored after being automatically separated from the high-pressure gas tank stored in the cabinet and then automatically fastened so as to close the gas injection nozzle when the high-pressure gas tank is replaced, such that the automatic replacement of the high-pressure gas tank can be realized. In addition, even if the valve of the valve handle is old and thus gas leaks when the end cap is removed, the gas injection nozzle can be closed by fastening the end cap quickly again, thereby preventing accidents such as explosions caused by gas leakage or accidents that cause workers to become addicted to the gas.

Third, the used gasket used is removed from the connector holder and automatically replaced with a new gasket, such that the toxic gas is prevented from leaking from the connection part of the high-pressure gas tank when supplying gas through the gas line.

DETAILED DESCRIPTION

Figure 1:
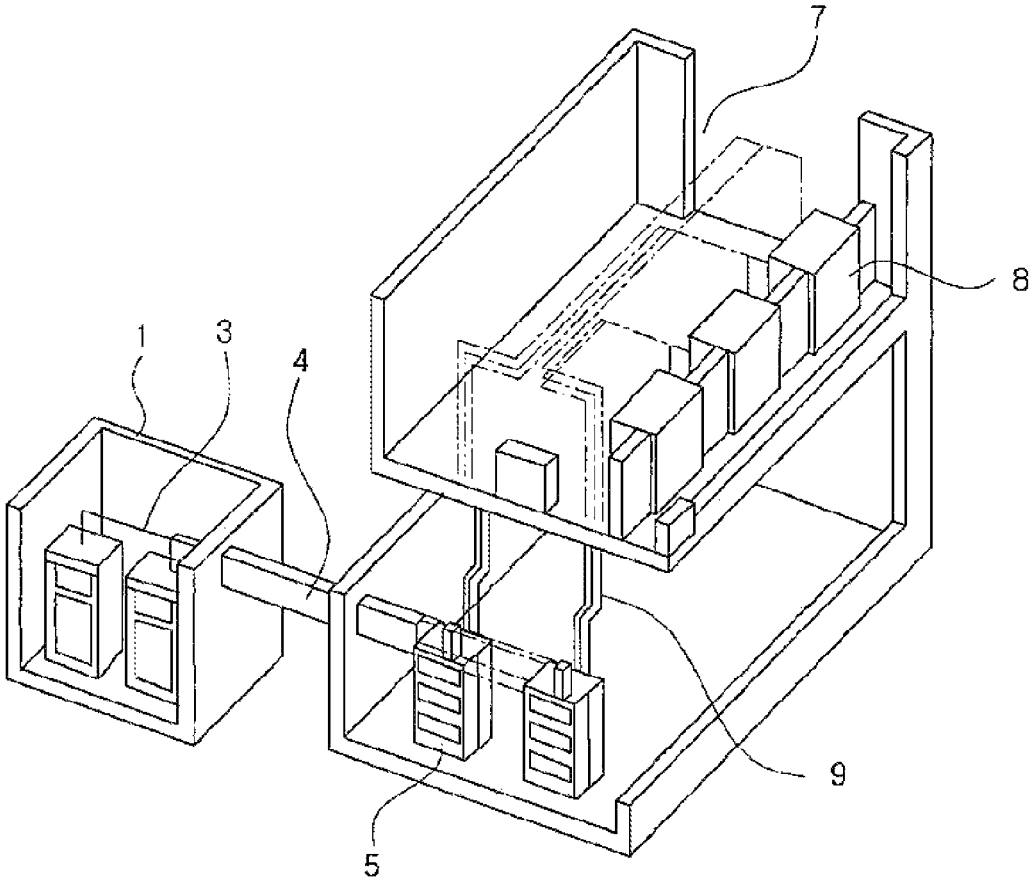
FIG. 1 is a perspective view schematically showing a gas supply device for semiconductor equipment according to the prior art

Hereinafter, exemplary embodiments of the present invention will be described in detail with reference to the accompanying drawings so that those skilled in the art may easily practice the present invention. The present invention may be embodied in many different forms and should not be construed as limited to the embodiments set forth herein. It should be noted that the figures are schematic and not drawn to scale. The relative dimensions and ratios of the parts in the figures are shown exaggerated or reduced in size for clarity and convenience in the figures, and any dimension is merely exemplary and not limiting. In addition, the same reference numerals are used to denote similar features in the same structures, elements, or parts shown in two or more figures.

Figure 2:
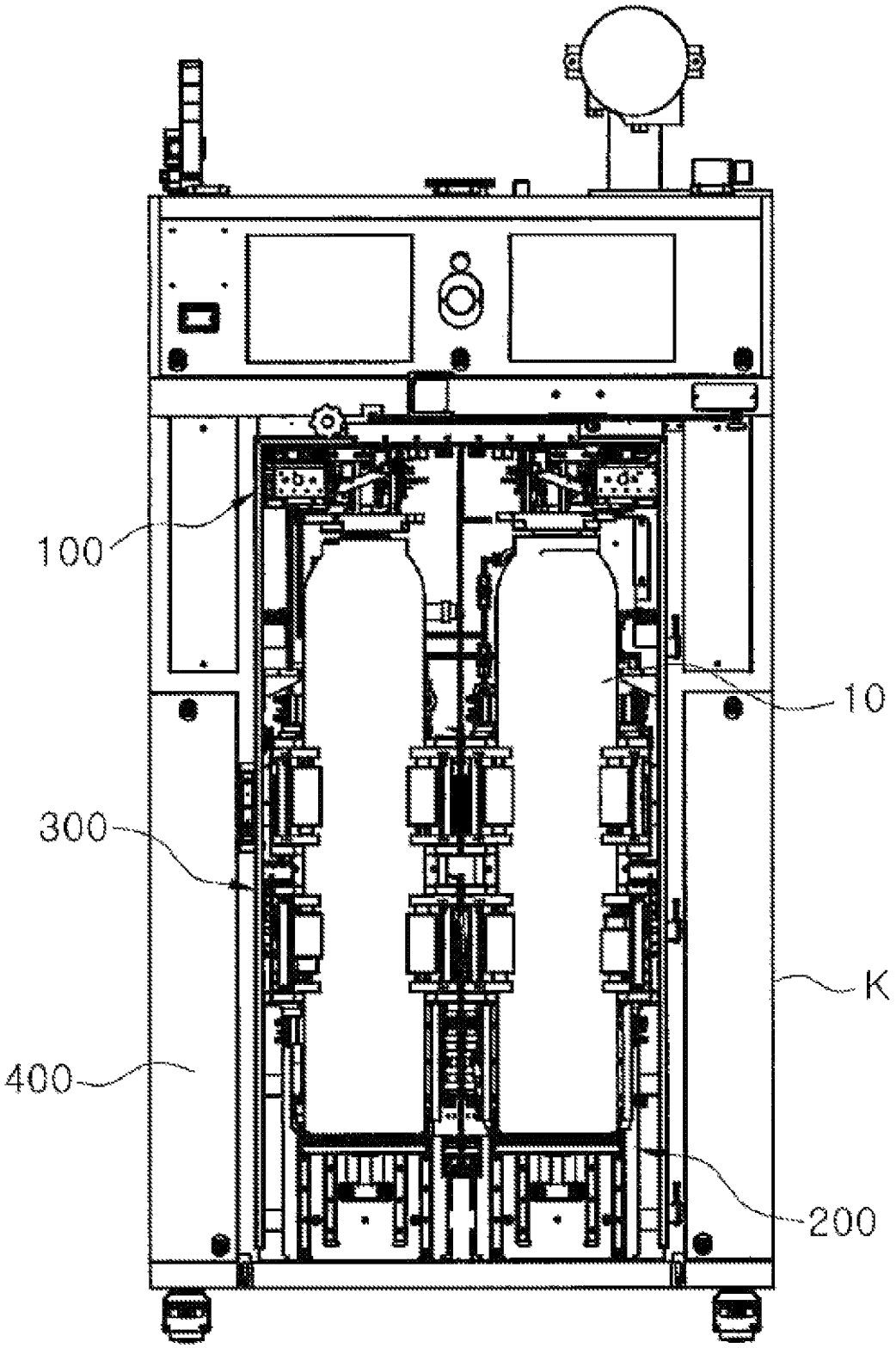
FIG. 2 is a front view showing a system for automatically replacing a high-pressure gas tank according to the present invention.
Figure 3A:
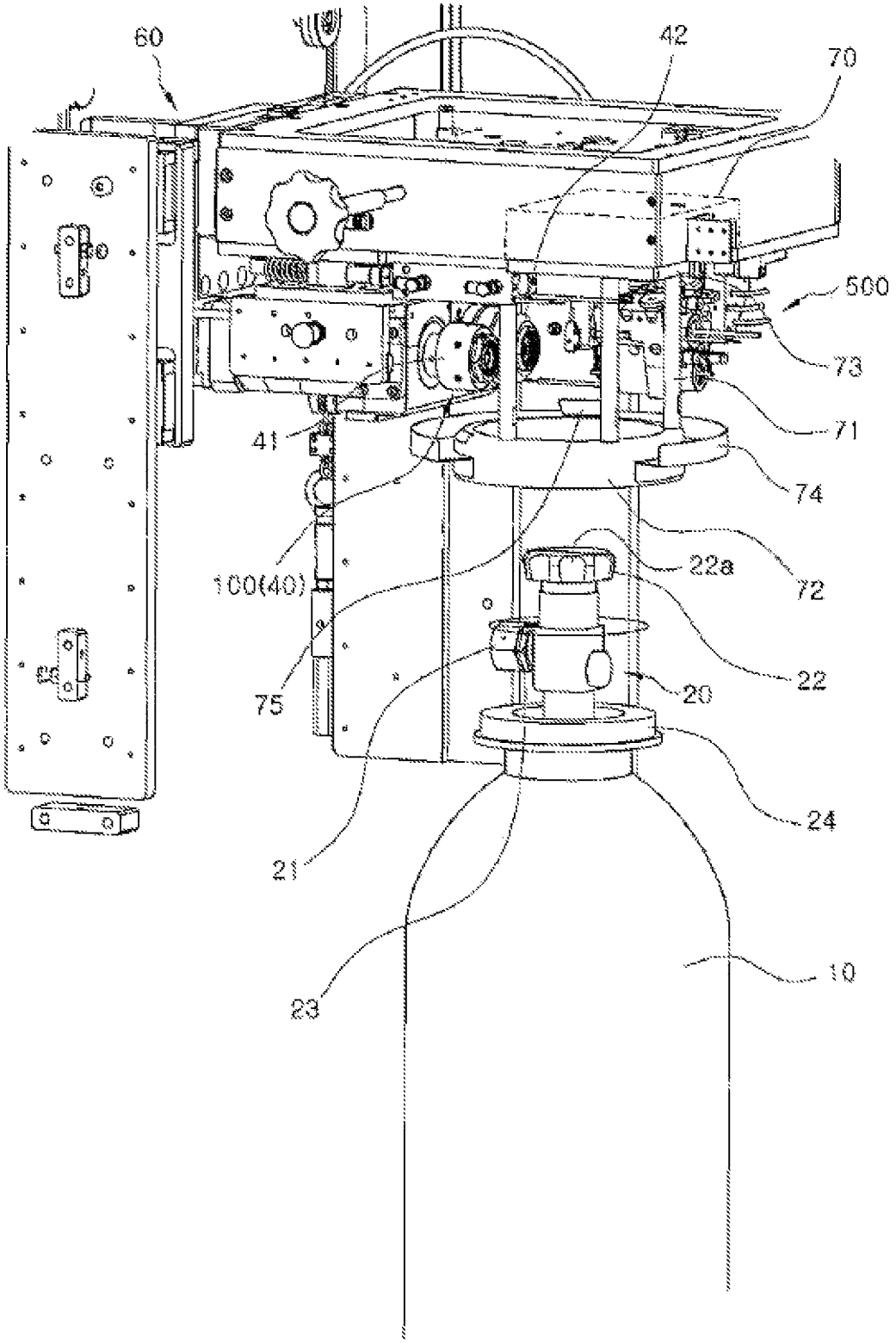
FIG. 3*a* and FIG. 3*b* are perspective views showing a high-pressure gas tank before and after being coupled to a high-pressure gas tank connection unit in the present invention.
Figure 3B:
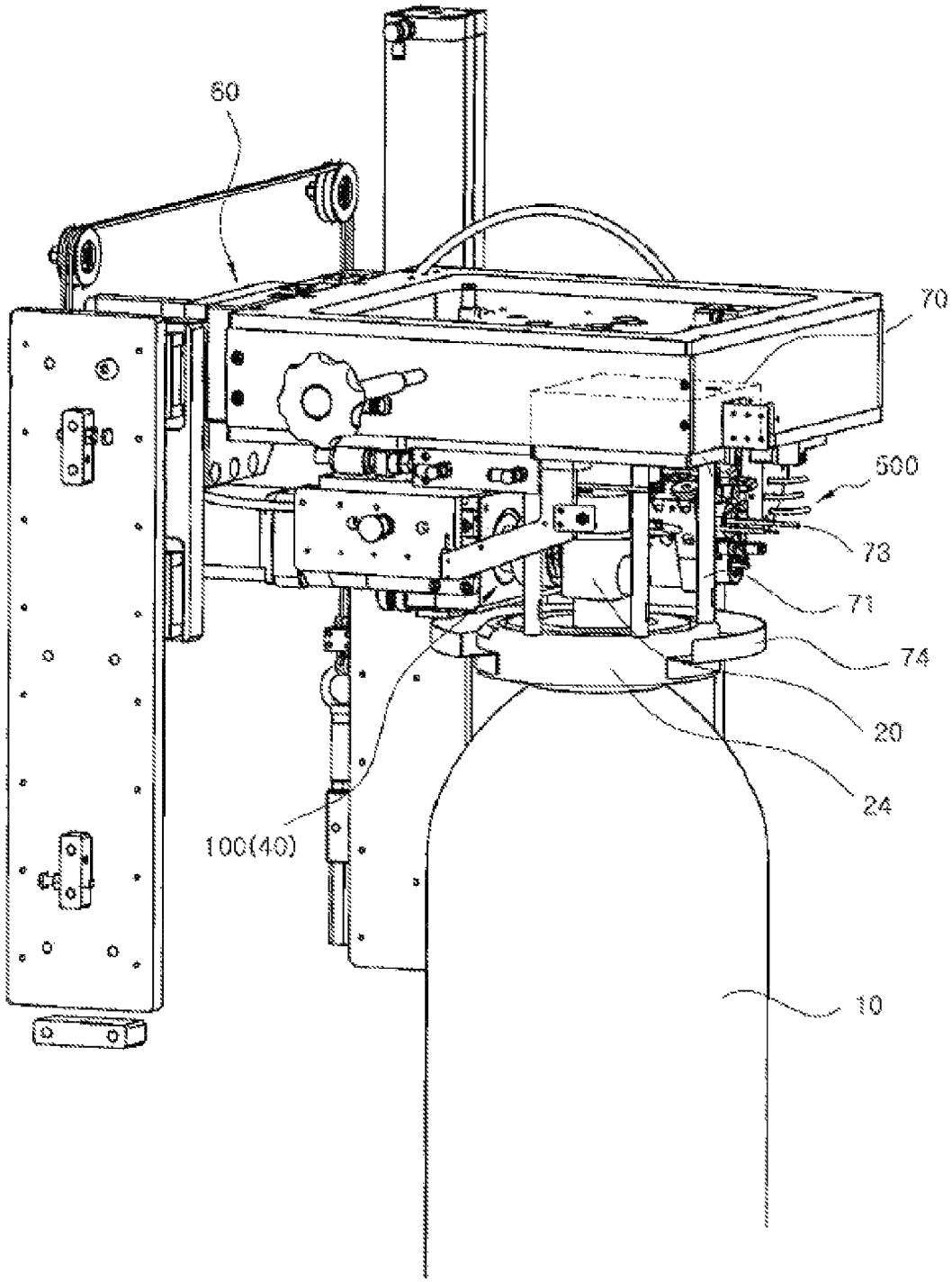
Figure 4:
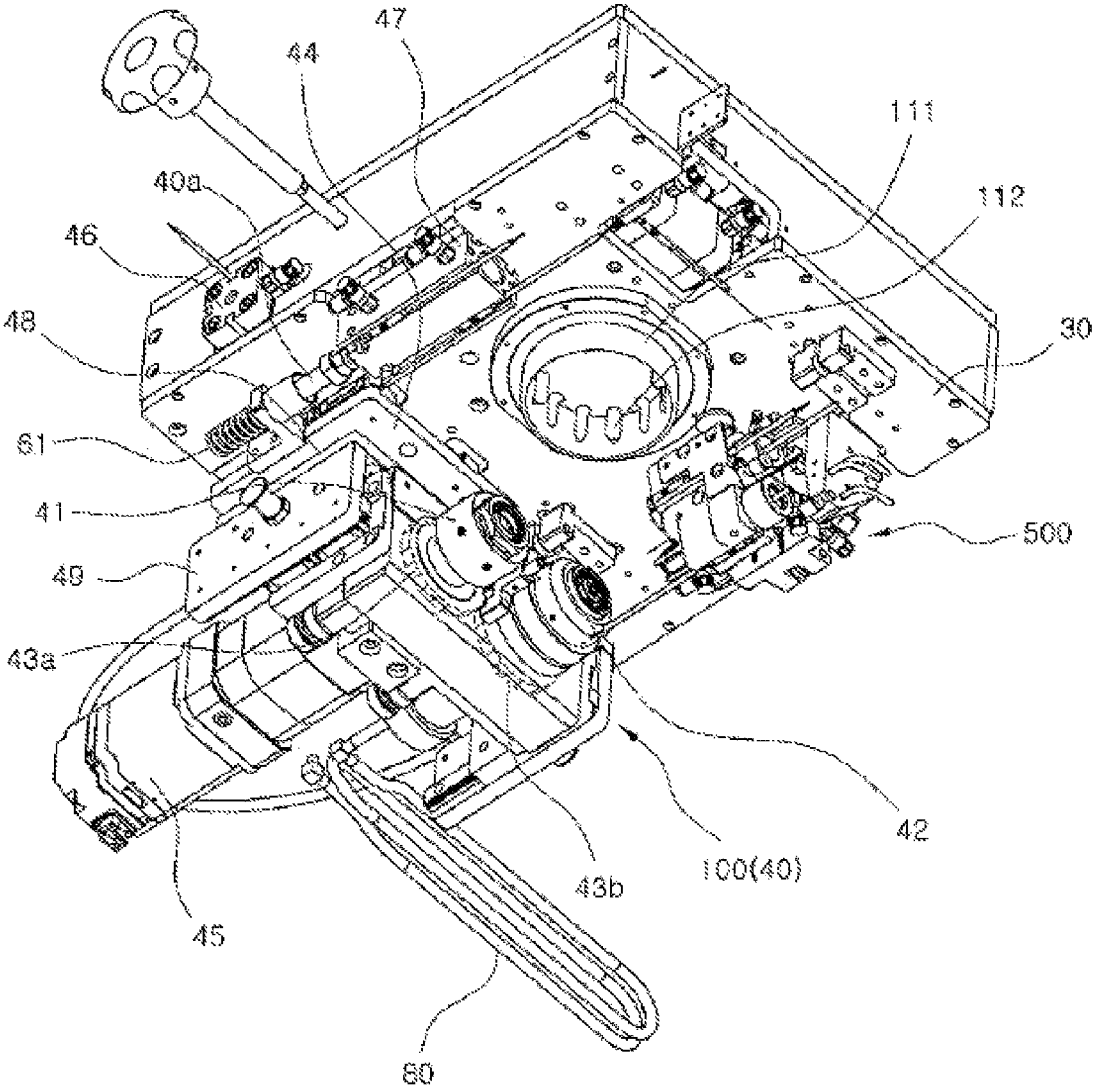
FIG. 4 is a bottom perspective view of the high-pressure gas tank connection unit in the present invention.

FIG. 2 is a front view showing a system for automatically replacing a high-pressure gas tank according to the present invention, FIG. 3*a* and FIG. 3*b* are perspective views showing a high pressure gas tank before and after being coupled to a high-pressure gas tank connection unit in the present invention, and FIG. 4 is a bottom perspective view of the high-pressure gas tank connection unit in the present invention. As shown in FIG. 2, the present invention includes a high-pressure gas tank lift 200 installed in a cabinet K so as to be elevated and including a die 201, on which a high-pressure gas tank 10 is loaded, a high-pressure gas tank clamp 300 for clamping the high-pressure gas tank 10 loaded on the die 201 of the high-pressure gas tank lift 200 and then aligning the position of the high-pressure gas tank 10, a high-pressure gas tank connection unit 100 for removing an end cap 21 from the high-pressure gas tank 10 elevated by the high-pressure gas tank lift 200 and then automatically connecting a connector holder 42 to a gas injection nozzle 23 so as to control the flow of a gas, and a control unit 400 installed in the cabinet k so as to control the driving of the high-pressure gas tank connection unit 100, the high-pressure gas tank lift 200, and the high-pressure gas tank clamp 300.

Figure 13:
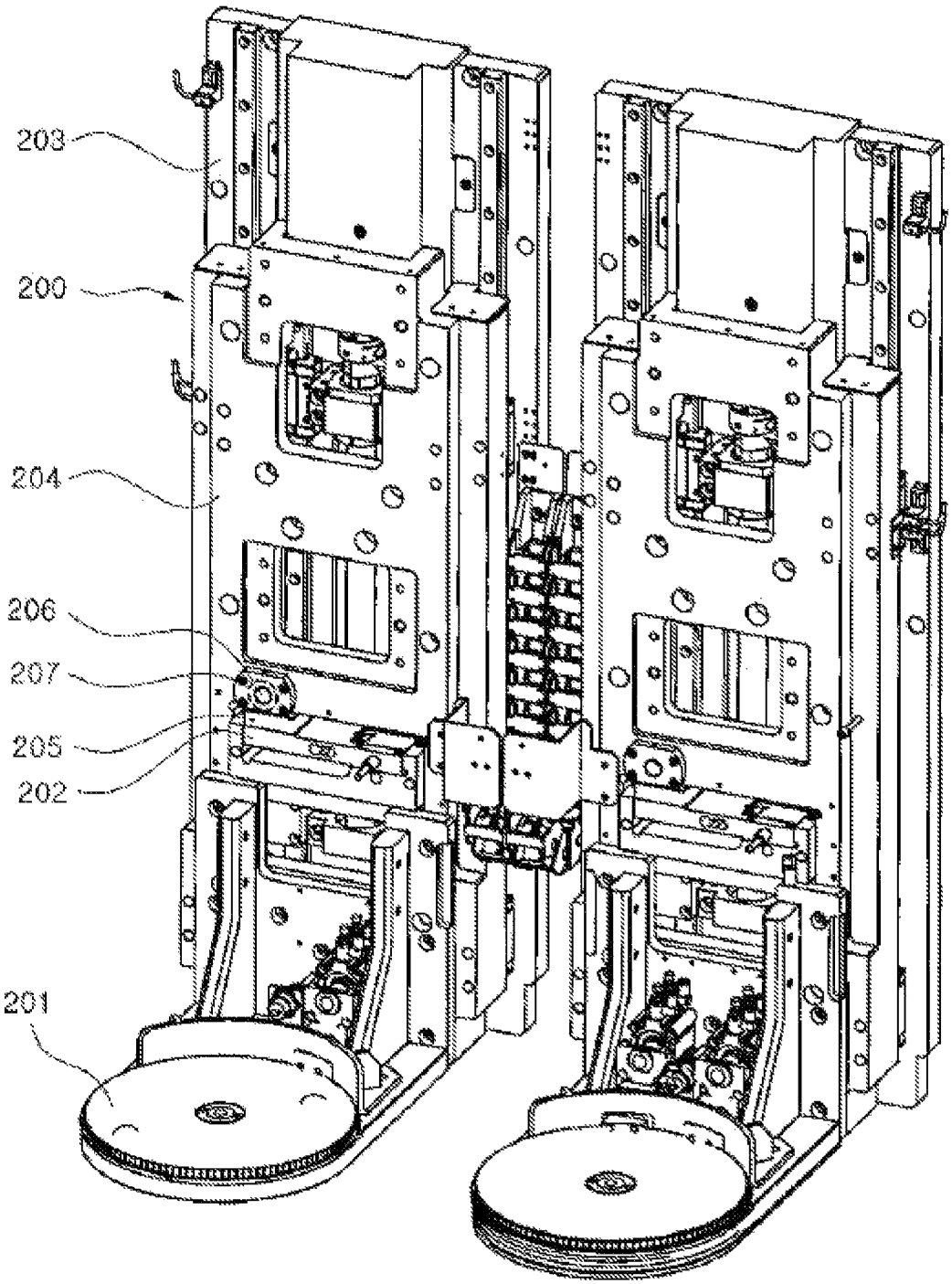
FIG. 13 is a perspective view of a high-pressure gas tank lift in the present invention.
Figure 14:
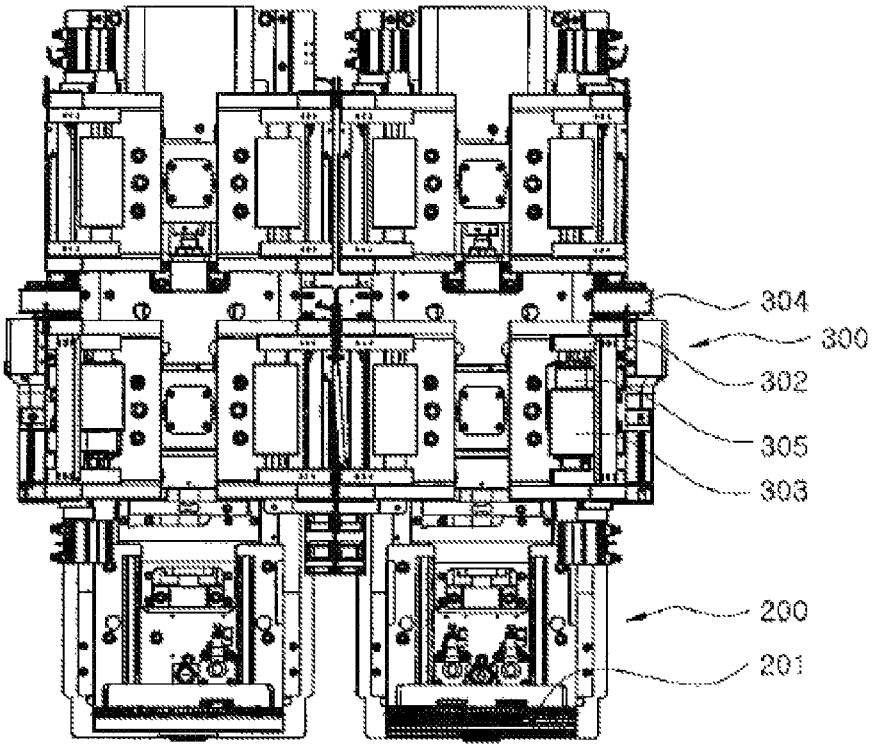
FIG. 14 shows a front view and a side view of FIG. 13.
Figure 14:
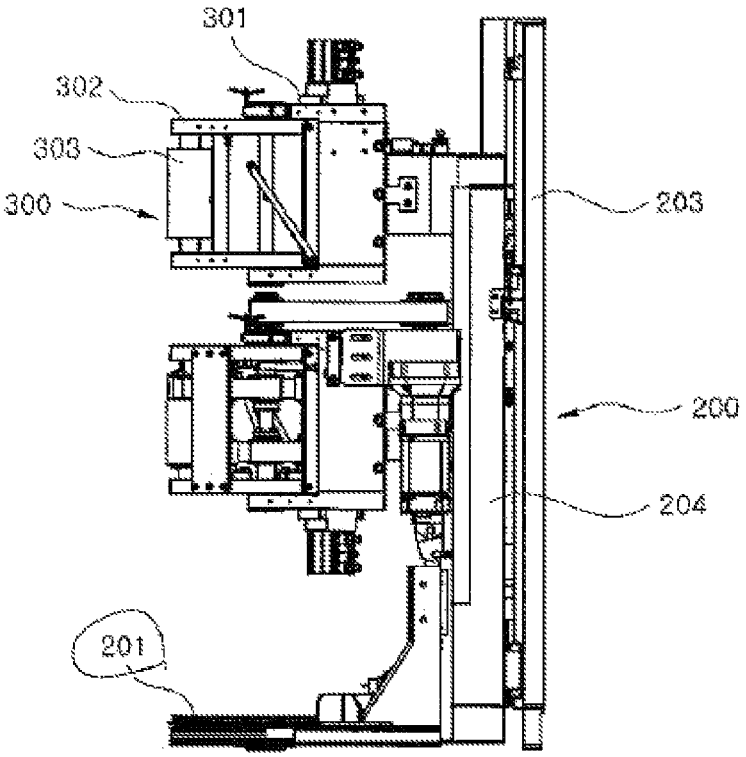

It is more preferable that the high-pressure gas cylinder lift 200 additionally has a function of adjusting the lifting height of the high-pressure gas tank 10 by installing a plurality of sensors (not illustrated), which detect the position of the high-pressure gas tank 10 on X, Y, and Z axes, on an auto coupler unit 70, which is shown in FIGS. 3*a* and 3*b*, such that after the high-pressure gas tank 10 is loaded on the die 201, as shown in FIG. 13 and FIG. 14, the end cap 21 or a connector holder 42 can be automatically fastened to the gas injection nozzle 23 of the high-pressure gas tank 10.

The weight of the high-pressure gas tank 10 loaded on the die 201 of the high-pressure gas tank lift 200 is measured by means of a load cell 202, as shown in FIG. 13, in the process of supplying gas through a gas line such that an alarm means (not illustrated) such as a buzzer or a warning light indicates when to replace the high-pressure gas tank 10.

That is, the high-pressure gas tank lift 200 includes a base 203, which is vertically installed in the cabinet k, and a moving base 204, which is provided to the base 203 so as to move up and down by a driving means (not illustrated) and has the die 201 provided at the lower end thereof.

In addition, an up/down ball screw (not illustrated) is installed in the base 203, and a moving block is installed on a ball screw nut, which is screw-coupled to the ball screw, so that the load cell 202 for measuring the weight of the high-pressure gas tank 10 is installed thereon. A bearing slide block 205 is loaded on the top surface of the load cell 202 and a bearing 207 is rotatably installed around a bearing pin 206 fixed to the moving base 204 so as to come into contact with the bearing slide block 205 with the bottom surface thereof.

Therefore, if gas is supplied from the high-pressure gas tank 10, the weight of the high-pressure gas tank 10 loaded on the die 201 of the moving base 204 is applied to the load cell 202 through the bearing 207 and thus the load cell 202 measures the weight of the high-pressure gas tank 10 so as to inform the control unit 400 of the replacement time of the high-pressure gas tank 10 when the gas of the high-pressure gas tank 10 is exhausted.

However, depending on the type of gas filled in the high-pressure gas tank 10, in the case where the high-pressure gas tank 10 is filled with gas having a low specific gravity, the change in weight is small even when the gas is exhausted and accordingly there is a limit in detecting the change of weight by means of the load cell. Therefore, it would be understood that a pressure sensor (not illustrated) may be installed on a gas pipe 80 so as to indicate the replacement time of the high-pressure gas tank in such a case.

Figure 15A:
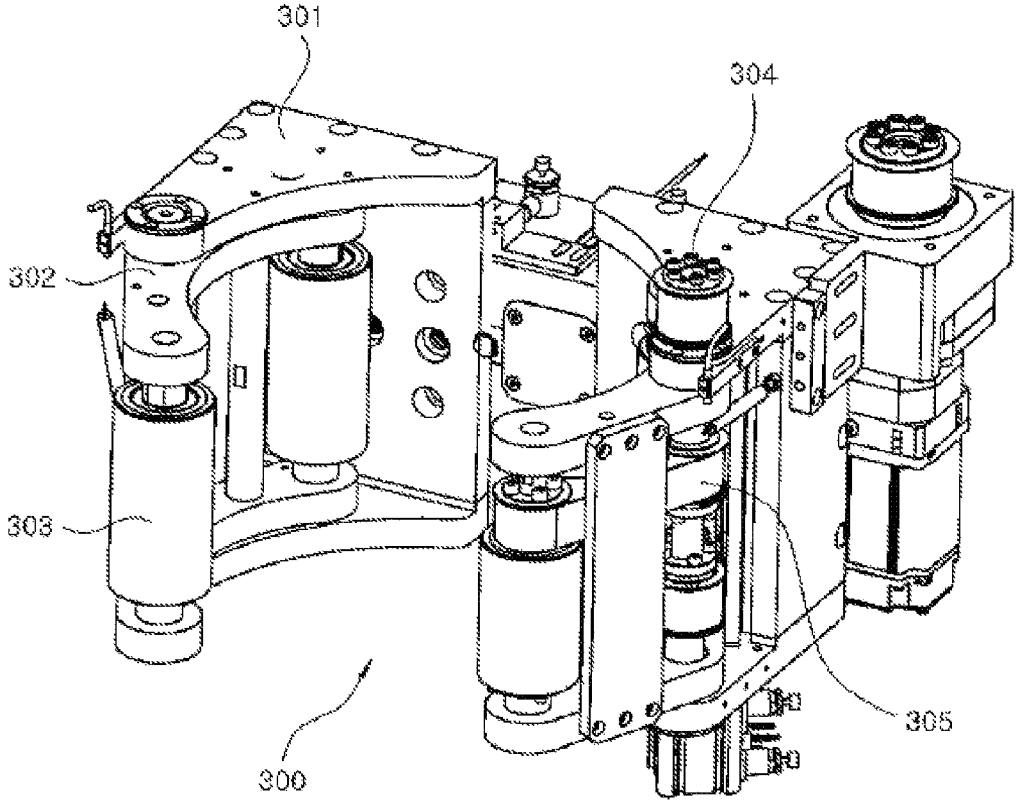
FIG. 15*a* and FIG. 15*b* are a perspective view and a bottom perspective view showing a high-pressure gas tank clamp in the present invention.
Figure 15B:
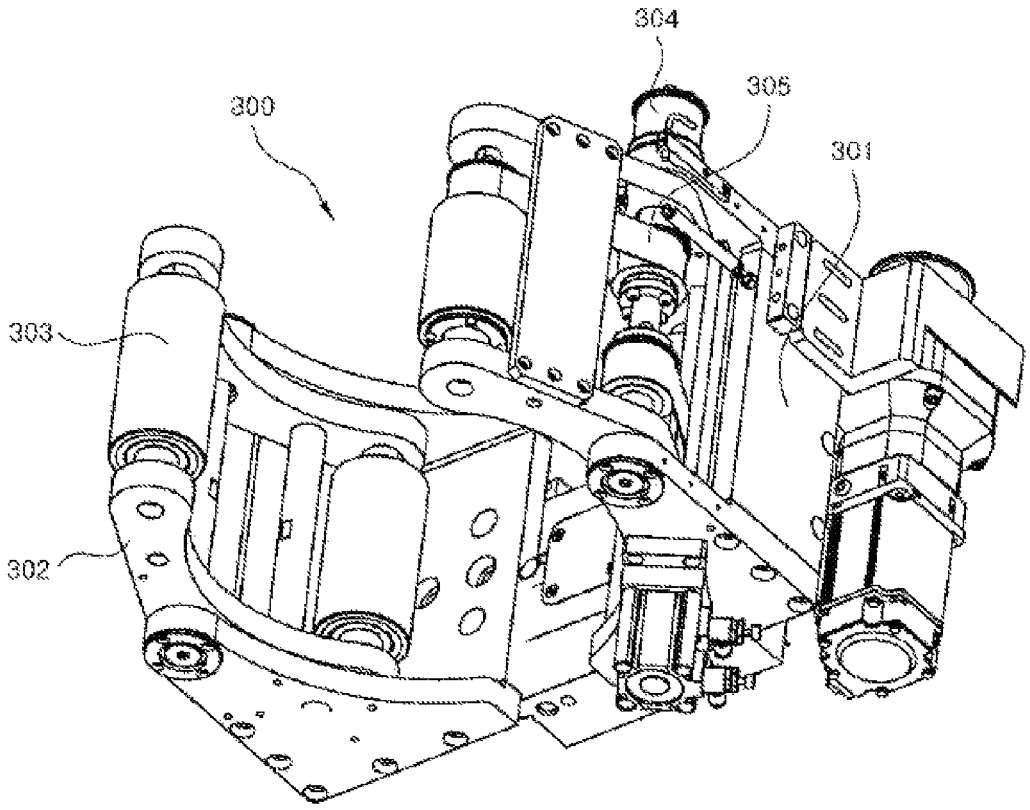
Figure 16:
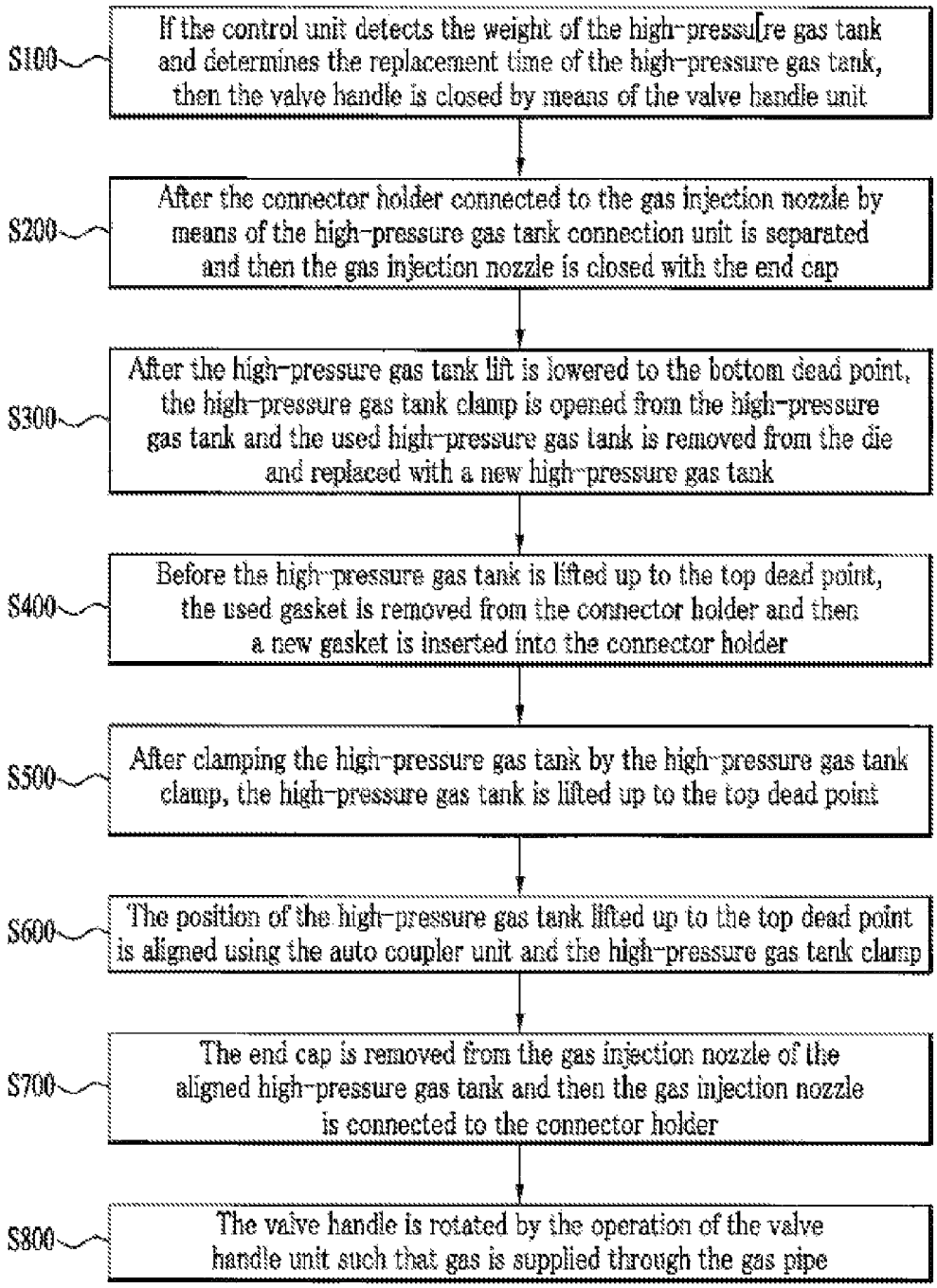
FIG. 16 is a flow chart for explaining a method for automatically replacing a high-pressure gas tank according to the present invention.

As shown in FIG. 14 and FIG. 15, the high-pressure gas tank clamp 300 is installed on the moving base 204 symmetrically and includes one pair of grippers 302, which are structured to be opened or closed when a fifth actuator 304 is driven, and rollers 303, which are rotatably installed respectively at both ends of the grippers so as to clamp the high-pressure gas tank 10, wherein if the high-pressure gas tank 10 is loaded on the die 201 of the high-pressure gas tank lift 200, the fifth actuator 304 is driven so as to close the grippers 302 such that the high-pressure gas tank 10 is clamped by the high-pressure gas tank clamps 300 while being aligned with the grippers 302.

FIG. 3*a* and FIG. 3*b* are perspective views showing a high-pressure gas tank before and after being coupled to a high-pressure gas tank connection unit in the present invention. The auto coupler unit 70 for aligning the gas injection nozzle 23 of the high-pressure gas tank with the connector holder 42 is installed on the high-pressure gas tank connection unit 100, to which the high-pressure gas tank 10 loaded on the die 201 of the high-pressure gas tank lift 200 is lifted and connected, a centering guide 72 fixed by a plurality of supports 71 so as to center the high-pressure gas tank 10 is fixed to the bottom surface of the auto coupler unit 70, and a safety cap nut ring 24 is fixed to the upper portion of the high-pressure gas tank 10, such that the high-pressure gas tank 10 is lifted by the high-pressure gas tank lift 200 as shown in FIG. 3*b*, wherein since the auto coupler unit 70 has degrees of freedom tilt in the X and Y directions, the high-pressure gas tank 10 fixed to the high-pressure gas tank clamp 300 is centered while being coupled to a centering guide 24.

In addition, a removed gasket receiver 74 is installed outside the centering guide 72 so as to receive a gasket 105 which is removed when the gasket 105 is inserted into the connector holder 42, and a gasket removal guide 75 is further installed on an upper portion of the removed gasket receiver 74 positioned directly below the connector holder 42 and guides the gasket 105 removed from the connector holder 42 to the removed gasket receiver 74.

FIG. 4 is a bottom perspective view of the high-pressure gas tank connection unit in the present invention. After the high-pressure gas tank 10 is lifted by the high-pressure gas tank lift 200 while being loaded on the die 201 and then completely aligned, the high-pressure gas tank connection unit 100 serves to remove the end cap 21 from the gas injection nozzle 23 of the high-pressure gas tank 10 and then automatically connect the gas injection nozzle 23 of the high-pressure gas tank 10 to the connector holder 42.

The high-pressure gas tank connection unit 100 includes a high-pressure gas tank connection part 40 installed at the lower portion of the main plate 30 so as to detach or attach the end cap 21 or to automatically fasten or disconnect the connector holder 42 to or from the gas injection nozzle 23 of a valve 20, a valve handle unit 110 installed at an upper portion of the main plate 30 so as to automatically open or close a valve handle 22 that controls the flow of gas, and a movement part 60 installed at one side of the main plate 30 so as to move the main plate 30 up and down.

Herein, a sensor 31 is installed on the main plate 30 so as to detect the gas leaking from the high-pressure gas tank 10, thereby preventing accidents due to gas leakage.

The high-pressure gas tank connection part 40 of the high-pressure gas tank connection unit 100 includes, as shown in FIG. 4, a second actuator 47 installed on the main plate 30 so as to move a second mounting plate 44 back and forth with respect to the end cap 21 side, a first actuator 46 installed on the second mounting plate 44 so as to move the first mounting plate 48 in a direction orthogonal to the movement direction of the second mounting plate 44, an end cap holder 41 rotatably installed on a vertical plate 49 fixed to the first mounting plate 48 so as to attach or detach the end cap 21 by enclosing the end cap 21, a third actuator 45 for rotating the end cap holder 41 so as to allow the end cap 21 to be separated or fastened, the connector holder 42 installed on the vertical plate 49 so as to be screw-coupled to the gas injection nozzle 23 of the high-pressure gas tank 10, and first and second gears 43*a*, 43*b* respectively fixed to the shafts of the end cap holder 41 and the connector holder 42 so as to be engaged with each other such that the power of the third actuator 45 is transmitted.

Figure 5:
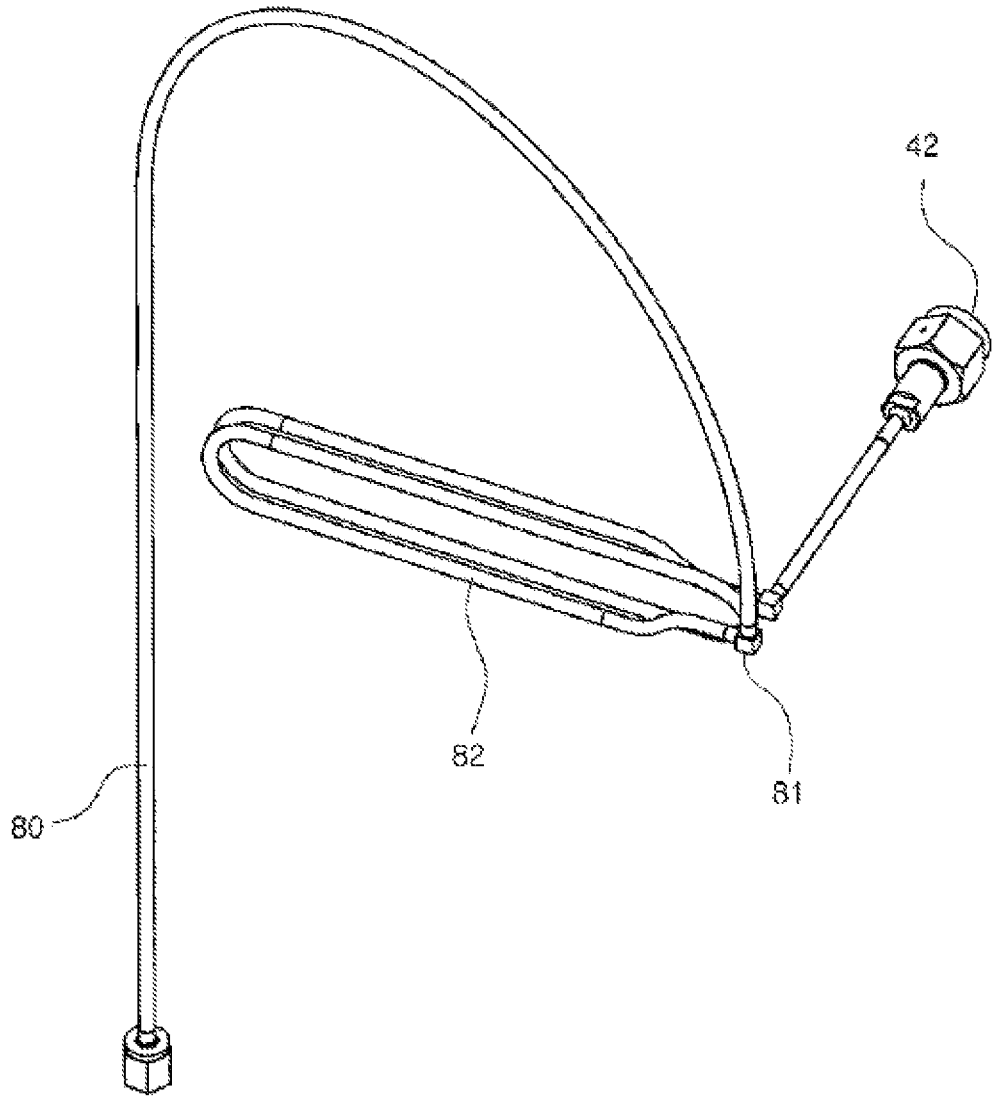
FIG. 5 is a perspective view showing a gas pipe used for the high-pressure gas tank connection unit of the present invention.

It is preferable that the gas pipe 80 for supplying gas through the gas line with one end fixed to the connector holder 42 includes a two-stranded spare pipe 82 provided in a long oval shape at a connection point of a "P" shape, as shown in FIG. 5, so as to reduce distortion caused by the lifting or lowering of the main plate 30 and to secure movement in the X- and Y-axis directions during coupling or decoupling to or from the gas injection nozzle 23 of the high-pressure gas tank 10.

Figure 12:
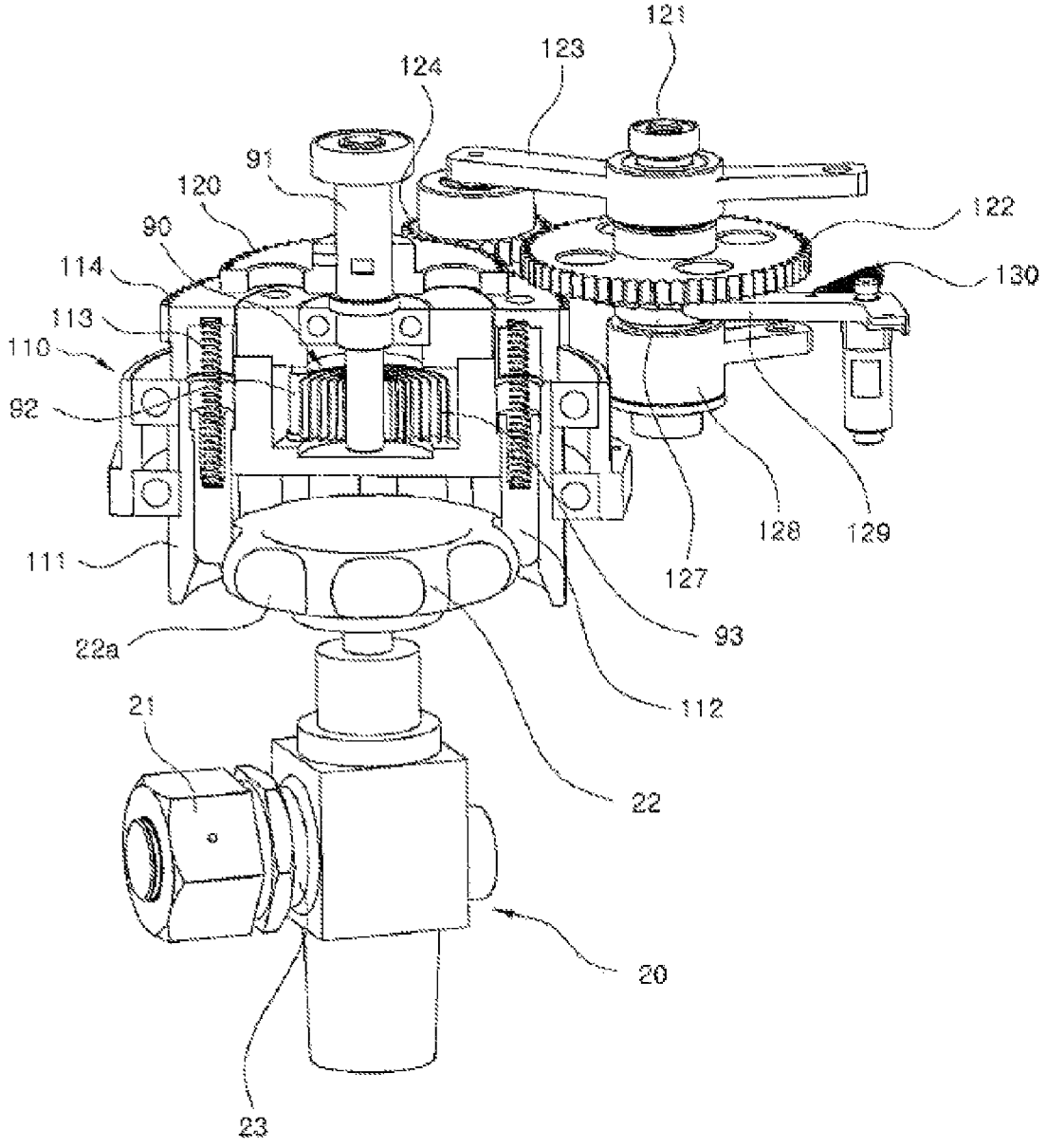
FIG. 12 is a perspective view showing the cross section of the valve handle unit of the present invention.

FIG. 12 is a perspective view showing the cross section of the valve handle unit of the present invention, which serves to automatically open or close the valve handle 22 of the high-pressure gas tank 10.

The valve handle unit 110 includes a valve handle holder 111 for wrapping and rotating the valve handle 22 of the high-pressure gas tank 10, a plurality of locking pins 112 installed on the inside of the valve handle holder 111 so as to be locked in the recess grooves 22*a* of the valve handle 22, a fourth elastic member 113 for elastically pressing the locking pin 112 downwards, and a valve handle gear 114 positioned on the upper portion of the valve handle holder 111 so as to rotate in engagement with a rack 58.

Figure 9:
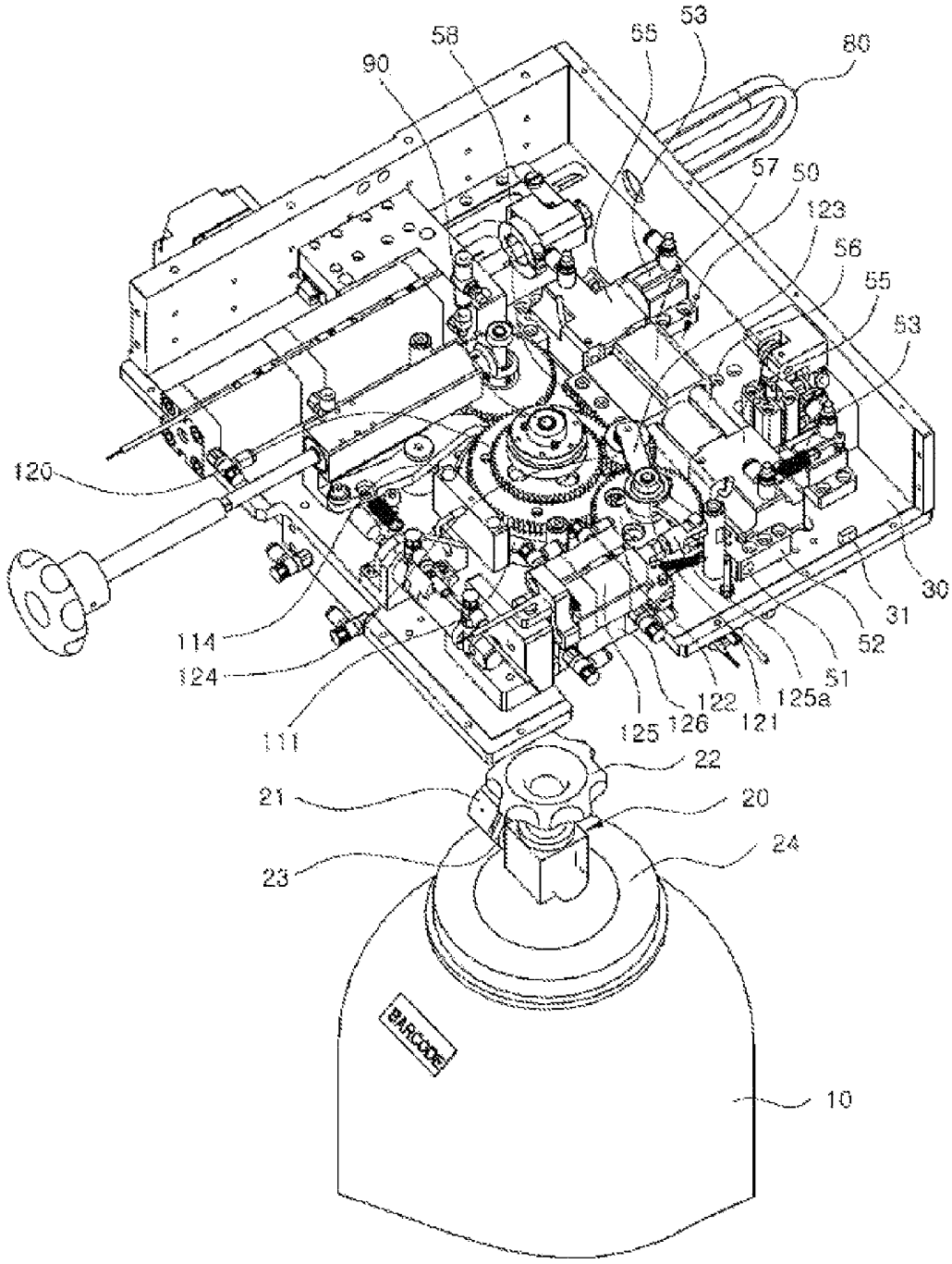
FIG. 9 is a perspective view showing a valve handle unit, a valve handle opening and closing unit, and a spring winding unit in the present invention.
Figure 10:
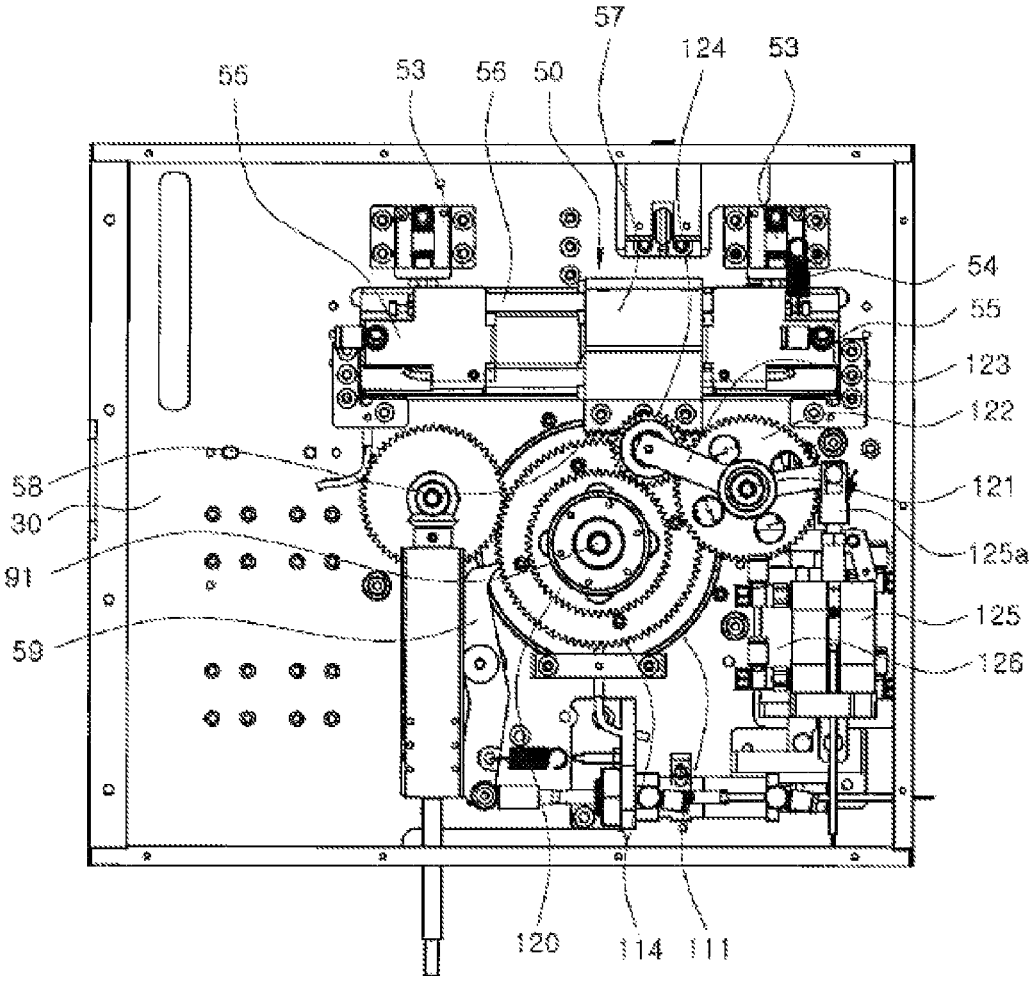
FIG. 10 is a top view of FIG. 9.
Figure 11:
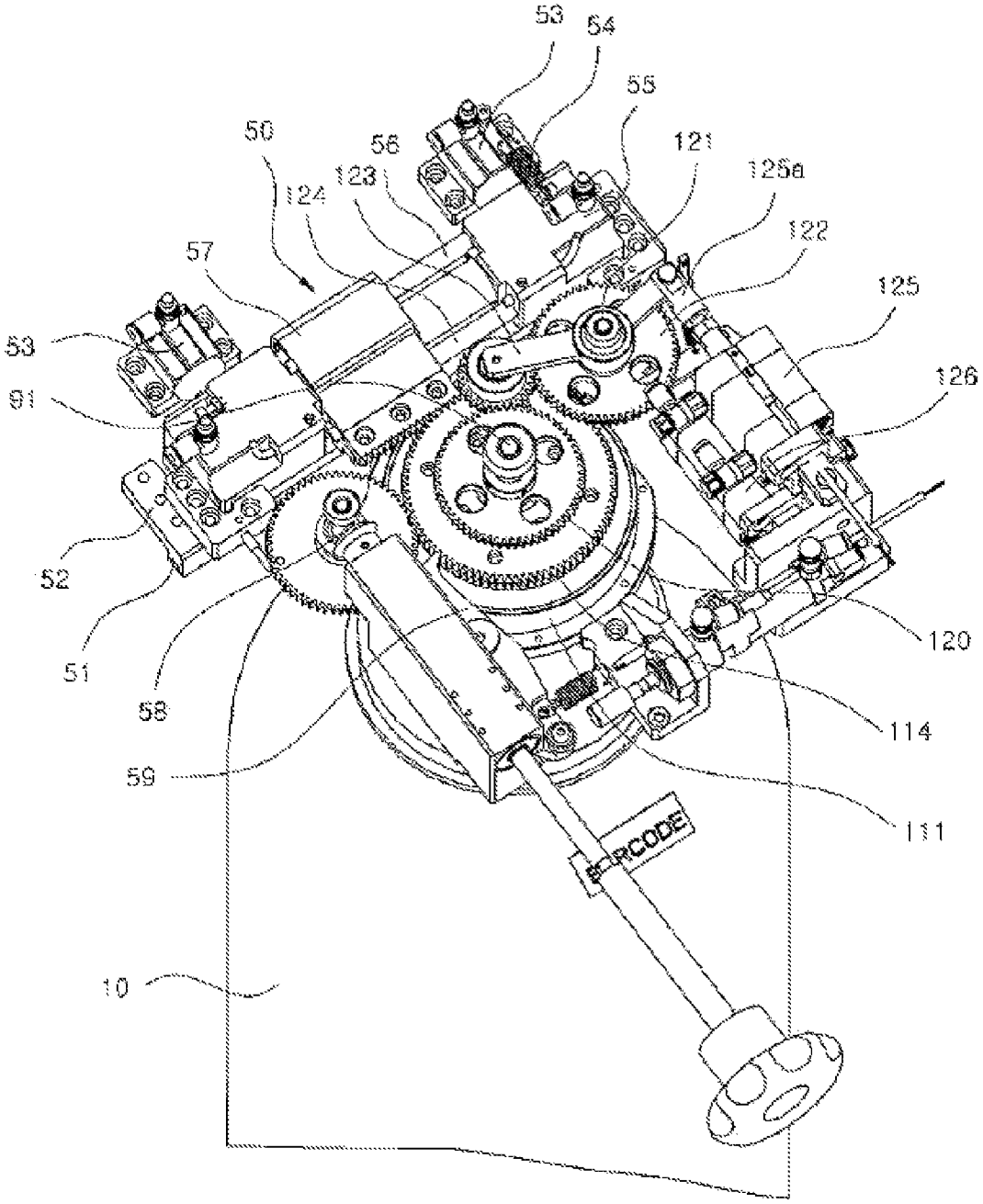
FIG. 11 is a perspective view, in which a main plate is removed in the present invention.

FIG. 9 is a perspective view showing the valve handle unit, the valve handle opening and closing unit, and the spring winding unit of the present invention and FIG. 10 is a top view of FIG. 9, in which a valve handle opening and closing unit 50 for automatically opening or closing the valve 20 of the high-pressure gas tank 10 is further provided on the upper portion of the main plate 30.

The valve handle opening and closing unit 50 includes, as shown in FIG. 9, a rotation member 52 installed on the main plate 30 so as to rotate around a hinge shaft 51, a rotation member actuator 53 installed on the main plate 30, which is positioned on one side of the rotation member 52, so as to rotate the rotation member 52, a third elastic member 54 installed between the rotation member 52 and the rotation member actuator 53, one pair of rack drive actuators 55 fixed and mounted to the rotation member 52, a moving piece 57 driven by the rack drive actuators 55 so as to move back and forth through the guide of a guide rod 56, a rack 58 fixed to the moving piece 57 and engaged with the valve handle gear 114, and a first latch 59 to be held by the valve handle gear 114 so as to prevent the valve handle gear 114 from rotating in reverse when winding a spring 93 that has one end fixed to the first shaft 91 and the other end fixed to the fixing pin 92.

The present invention more preferably includes a spring winding unit 90 provided in the valve handle opening and closing unit 50 so as to automatically lock the valve handle 22 of the high-pressure gas tank 10 in case of accidental gas leakage or sudden power failure during the supply of gas from the high-pressure gas tank 10 through the gas pipe 80.

The spring winding unit 90 includes, as shown in FIG. 12, a first shaft 91 installed in the center of the valve handle unit 110, a fixing pin 92 installed so as to be positioned inside the valve handle unit 110, and the spring 93 having one end fixed to the fixing pin 92 and the other end fixed to the first shaft 91 so as to be wound as the first shaft 91 is rotated in a direction, in which the valve handle 22 is opened.

The spring winding unit 90 is further provided with a driving means for preventing wound spring from loosening when winding the spring 93 and allowing the wound spring 93 to automatically release and the valve handle 22 to rotate with speed in a direction, in which the valve 20 is closed, when the gas leaks.

The driving means includes, as shown in FIG. 9 and FIG. 12, a spring drive gear 120 fixed to the first shaft 91 so as to be positioned on the upper portion of the valve handle gear 114, a second shaft 121 rotatably installed on the main plate 30, an amplification gear 122 fixed to the second shaft 121 so as to amplify the rotational speed of the second shaft 121, a link 123 fixed to the second shaft 121, a planetary gear 124 installed in engagement with the amplification gear 122 at one end of the link 123 so as to be engaged with or disengaged from the spring drive gear 120, a second latch wheel 127 fixed to the second shaft 121, a second latch 129 engaged with the second latch wheel 127 so as to prevent the second shaft 121 from rotating in reverse when a one-way clutch 128 is restored, a second elastic member 130 to which one end of the second latch 129 is connected, a planetary gear drive actuator 125, of which a rod 125*a* is connected to the other one end of the link 123 so as to rotate the link 123, and a spring winding actuator 126 for rotating the second shaft 121 so as to enable the spring 93 to be wound around the first shaft 91.

Figure 6A:
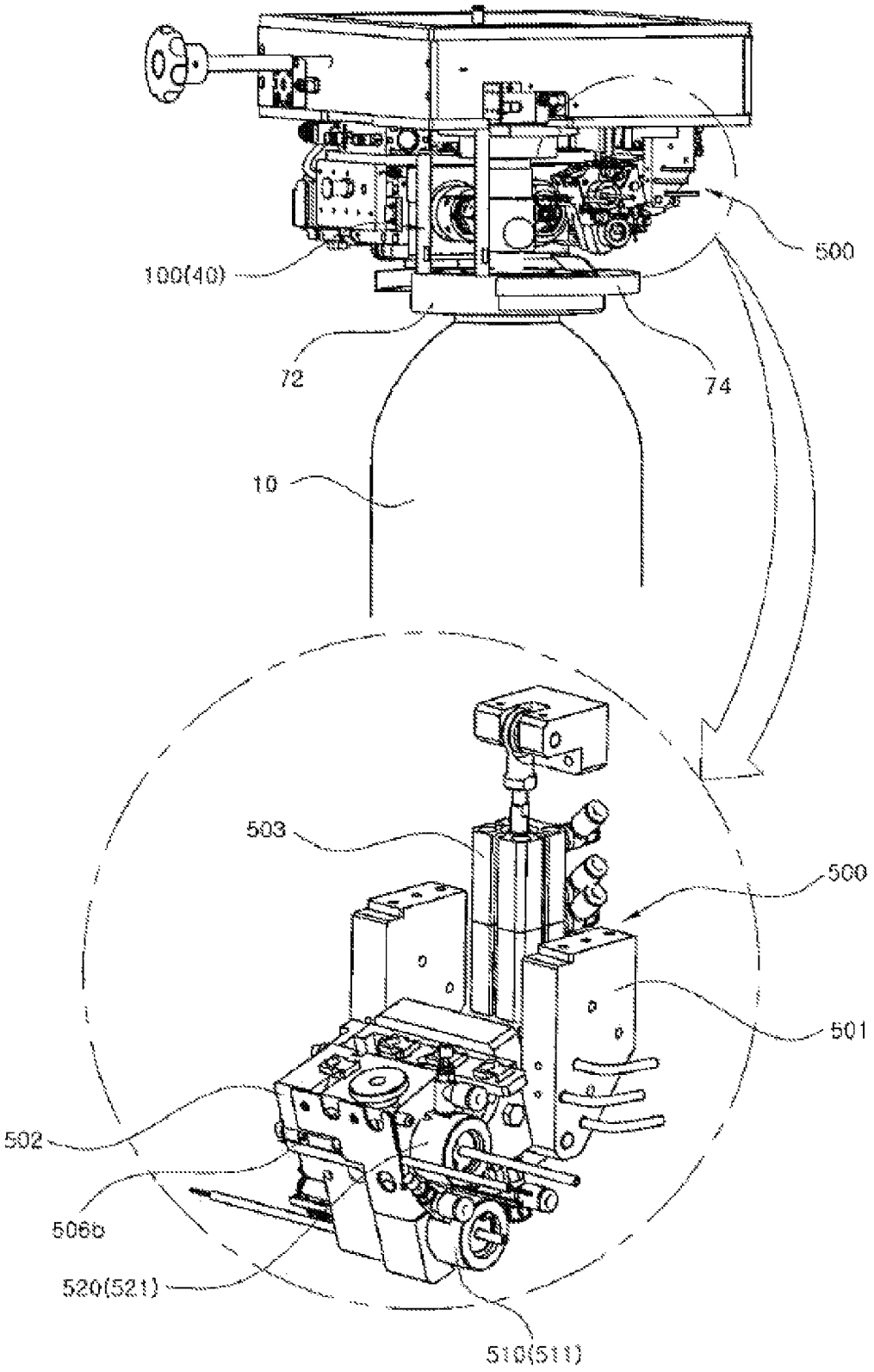
FIG. 6*a* and FIG. 6*b* are perspective views showing a gasket automatic replacement means according to the present invention.
Figure 6B:
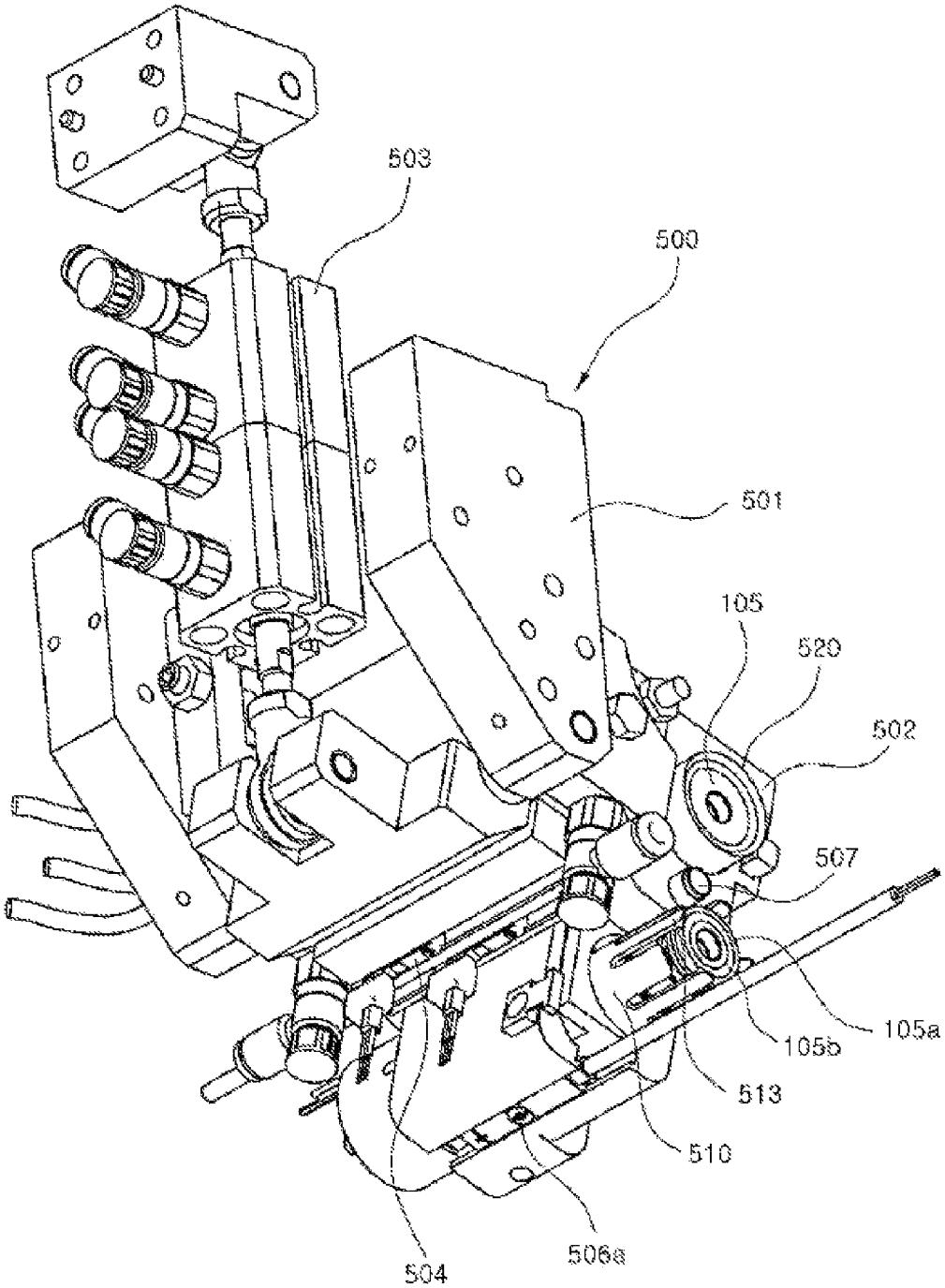
Figure 7:
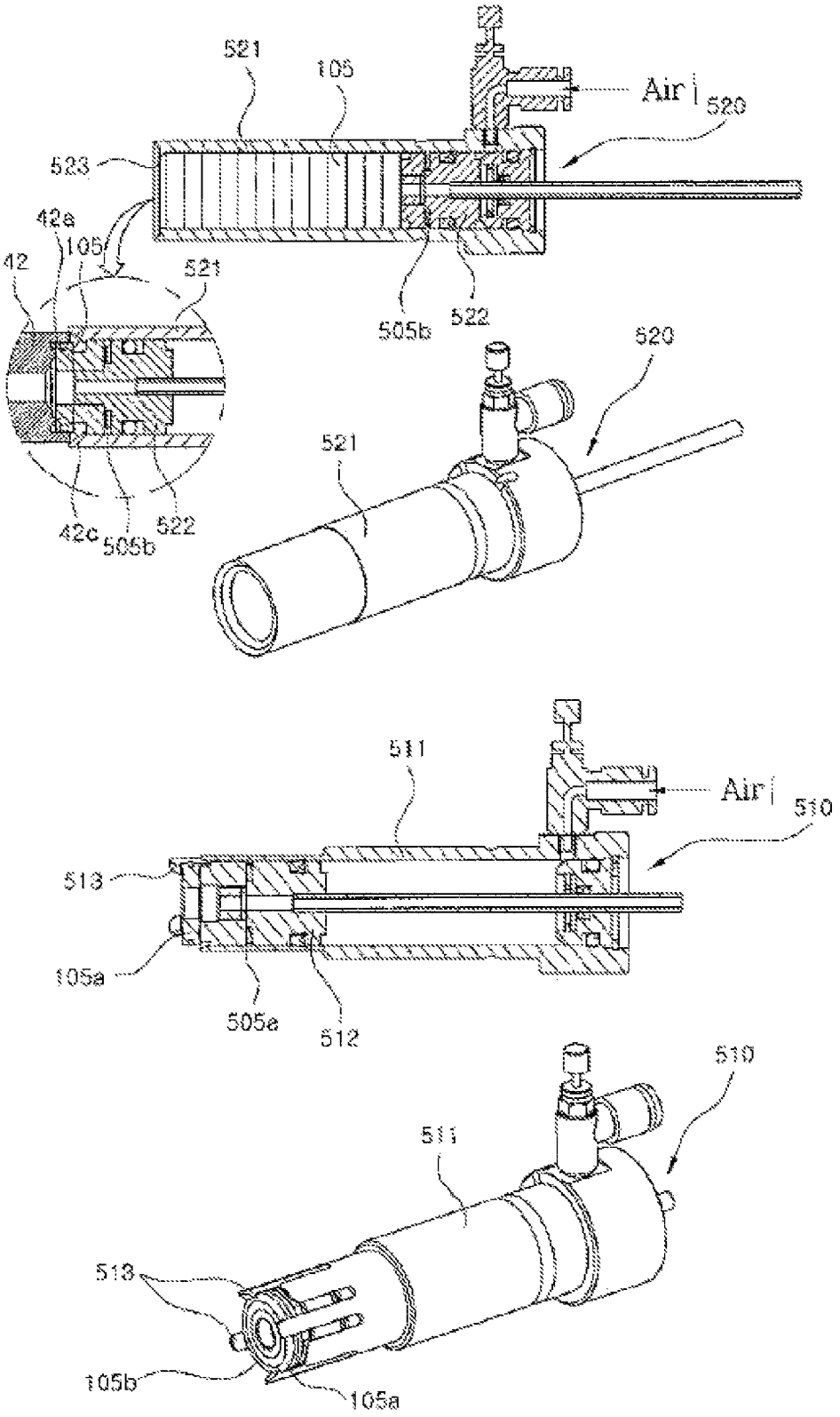
FIG. 7 shows cross-sectional views and perspective views of a gasket insertion cartridge and a gasket removal cartridge of the gasket automatic replacement means in the present invention.

FIG. 6*a* and FIG. 6*b* are perspective views showing a gasket automatic replacement means according to the present invention, and FIG. 7 shows cross-sectional views and perspective views of a gasket insertion cartridge and a gasket removal cartridge of the gasket automatic replacement means in the present invention. According to an embodiment of the present invention, the gasket 105 is made of metal so that particles are not generated by using the gasket 105, wherein if the gasket 105 is inserted into the connector holder 42 and the gas injection nozzle 23 of the high-pressure gas tank 10 is fastened, as shown in FIG. 7, since the both side surfaces of the gasket 105 are pressed and deformed by an annular protruding band 42*c* formed on the inlet portion of the connector holder 42 and the gas injection nozzle 23 so that a recess groove 105*b* is formed, the used gasket 105*a* has to be replaced whenever the high-pressure gas tank 10 is replaced.

To this end, the present invention is further provided with a gasket automatic replacement means 500 for automatically inserting a gasket 105 into the connector holder 42 of the high-pressure gas tank connection unit 100 or automatically removing a used gasket 105*a* therefrom.

The gasket automatic replacement means 500 includes, as shown in FIG. 6*a* and FIG. 6*b*, a holder 501 installed so as to be positioned at one side of the connector holder 42, a movement member 502 rotatably installed in the holder 501, a fourth actuator 503 installed in the holder 501 so as to rotate the movement member 502, a docking actuator 504 for enabling the movement member 502 to move back and forth from the holder 501 to the connector holder 42 side, a gasket removal cartridge 510 installed in the movement member 502 so as to automatically remove a used gasket 105*a* from the connector holder 42 and to accommodate the used gasket 105*a* in turn, and a gasket insertion cartridge 520 installed at the upper portion or the lower portion of the gasket removal cartridge 510 so as to insert a new gasket 105, which is accommodated in the gasket insertion cartridge 520, into the connector holder 42.

Figure 8:
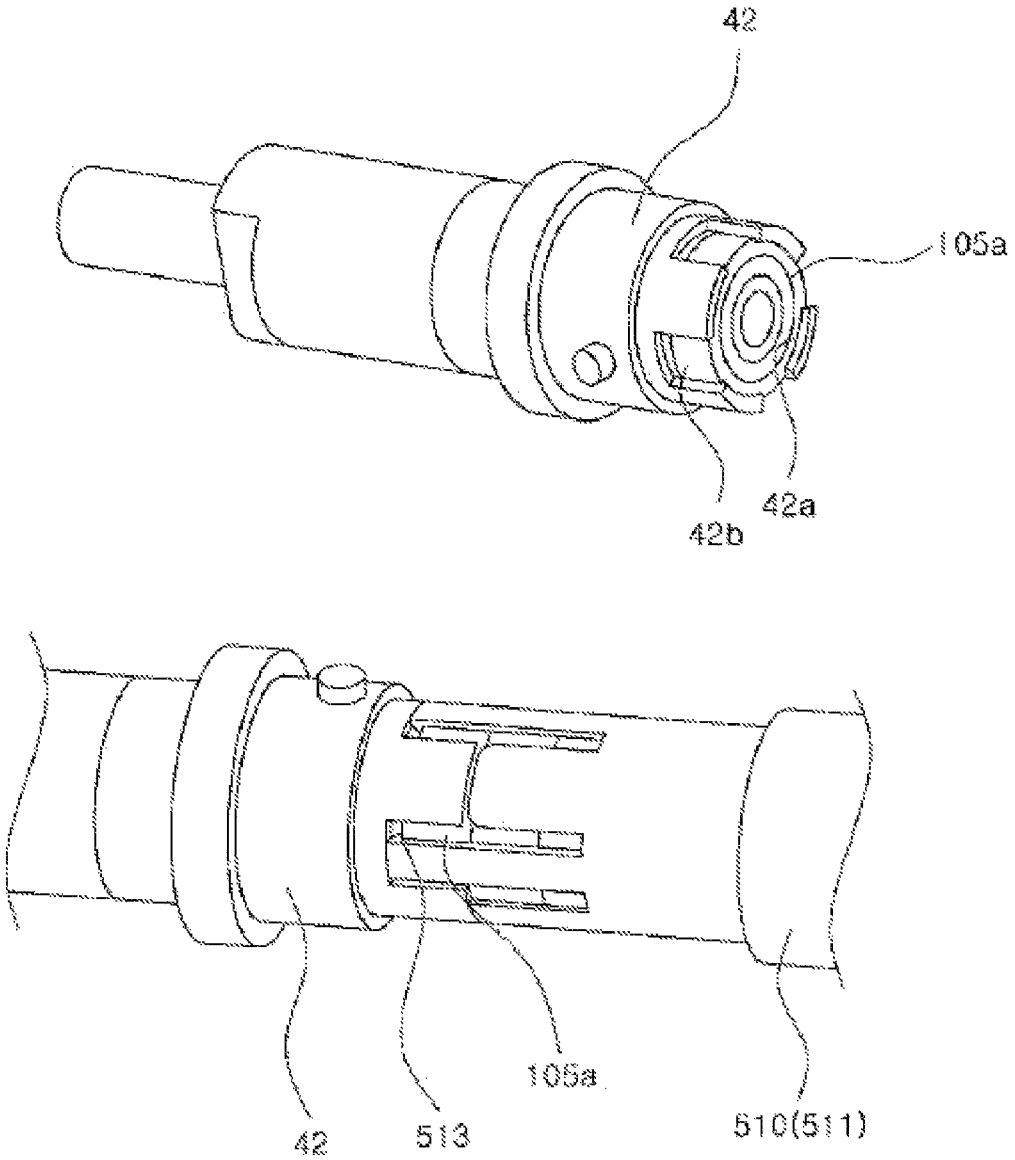
FIG. 8 is a perspective view of a gasket inserted into a connector holder in the present invention and the used gasket held by a gasket removal cartridge.

The gasket removal cartridge 510 includes, as shown in FIG. 7, a first sleeve 511 formed in a cylindrical shape so as to sequentially accommodate used gaskets 105*a*, a first piston 512 installed in the first sleeve 511 so as to move by air pressure, and holding pieces 513 formed at regular intervals on the front end of the first sleeve 511 so as to hold the gaskets 105*a*, wherein the connector holder 42 having a holding protrusion 42*a* on the inside thereof has cutout parts 42*b* formed at an inlet portion thereof so as to allow the respective holding pieces 513 to pass therethrough, as shown in FIG. 8, such that the used gaskets 105*a* are removed as the holding pieces 513 move through the cutout parts 42*b* and the movement member 502 moves backwards by the docking actuator 504 while holding the gaskets 105*a*.

In addition, the gasket insertion cartridge 520 includes, as shown in FIG. 7, a second sleeve 521 formed in a cylindrical shape so as to accommodate unused gaskets 105, a second piston 522 installed in the second sleeve 521 so as to move by air pressure, and a protrusion 523 formed on the inner circumferential surface of the outlet of the second sleeve 521 so as to limit the movement of the gaskets 105.

The lengths of the first and second sleeves 511 and 521 of the gasket removal cartridge 510 and the gasket insertion cartridge 520 can be adjusted appropriately so as to accommodate approximately 10 to 15 gaskets 105, 105*a* and thus need not be limited.

The gasket removal cartridge 510 and the gasket insertion cartridge 520 further include first and second detection means for detecting replacement time of the cartridges, and the first and second detection means include magnets 505*a*, 505*b* installed on the first and second pistons 512, 522, and first and second sensors 506*a*, 506*b* for sensing the magnets 505*a*, 505*b* so as to indicate the replacement time of the gasket removal cartridge 510 or the gasket insertion cartridge 520, wherein when the gasket removal cartridge 510 is full of used gaskets 105*a* or new gaskets 105 filled in the gasket insertion cartridge 520 are fully supplied to the connector holder 42, the first and second sensors 506*a* and 506*b* detect the state such that the gasket removal cartridge 510 and the gasket insertion cartridge 520 is replaced as a whole.

Herein, a reflective sensor 507 is installed on the movement member 502 positioned between the gasket removal cartridge 510 and the gasket insertion cartridge 520 and can detect whether any used gasket 105*a* remains in the connector holder 42, thereby preventing errors caused by not removing the used gasket 105*a*.

Now, the operation of the present invention will be described as follows.

First, the operation will be described in a state, in which after the high-pressure gas tank 10 is loaded on the die 201 of the high-pressure gas tank lift 200, the high-pressure gas tank 10 is lifted while being clamped by the high-pressure gas tank clamp 300 and the gas injection nozzle 23 of the valve 20 is coupled to the connector holder 42 such that gas is supplied to the gas line through the gas pipe 80.

As described hereinabove, if the weight of the high-pressure gas tank 10 is decreased as the gas is supplied from the high-pressure gas tank 10, the load cell 202 installed on the base 203 detects the weight of the high-pressure gas tank 10, and the control unit 400 determines the replacement time of the high-pressure gas tank 10, then the valve handle 22 is closed by means of the valve handle unit 110 (S100).

That is, the valve handle 22 closes the valve 20 since the valve handle holder 111 rotates in the clockwise direction as the rack drive actuator 55 and the rotation member actuator 53 are alternately driven so as to move the rack 58 of the valve handle opening and closing unit 50 to the right in FIG. 10 repeatedly.

However, the valve handle 22 of the valve 20 can be closed without using the valve handle opening and closing unit 50.

This is because the spring 93 of the spring winding unit 90 is wound around the first shaft 91 so that the first shaft 91 always has restoring force the force to rotate in the clockwise direction. Therefore, if the planetary gear drive actuator 125 is driven such that the planetary gear 124 is separated from the spring drive gear 120 and simultaneously the first latch 59 is separated from the valve handle gear 114, the first shaft 91 is rotated in the clockwise direction by the restoring force of the spring 93 and thus the valve handle holder 111 rotates in the clockwise direction and enables the valve handle 22 to rotate such that the valve 20 can be closed.

After the valve handle 22 closes the valve 20, the connector holder 42 connected to the gas injection nozzle 23 by means of the high-pressure gas tank connection unit 100 is separated and then the gas injection nozzle 23 is closed with the end cap 21 (S200).

In the operation of separating the connector holder 42 connected to the gas injection nozzle 23 therefrom and then closing the gas injection nozzle 23 with the end cap 21, in response to the operation of the first, second, and third actuators 45, 46, 47, the connector holder 42 screw-coupled to the gas injection nozzle 23 is separated therefrom and at the same time the gas injection nozzle 23 is closed with the end cap 21 accommodated in the end cap holder 41, such that the used high-pressure gas tank 10 can be replaced.

That is, when the connector holder 42 is rotated in the counterclockwise direction and separated from the gas injection nozzle 23 by the driving of the third actuator 45, the second mounting plate 44 with the third actuator 45 installed thereon moves to the left, as much as the connector holder 42 is released, by the restoring force of the elastic member 61 that is fitted around the rod 47*a* of the second actuator 47 and is thus compressed. Therefore, the connector holder 42 is separated from the gas injection nozzle 23 and, at this time, the second actuator 47 is driven so as to move the second mounting plate 44 backward from the high-pressure gas tank 10 side.

After the connector holder 42 is separated from the gas injection nozzle 23 in the above-mentioned operation, in order to screw-couple the end cap 21 stored inside the end cap holder 41 to the gas injection nozzle 23, the first actuator 46 is driven so as to move the first mounting plate 48 to the gas injection nozzle 23 side such that the end cap holder 41 and the gas injection nozzle 23 are positioned on the same axis.

Thereafter, the second actuator 47 is driven and at the same time the third actuator 45 rotates the end cap holder 41 in the clockwise direction so that the end cap 21 stored inside the end cap holder 41 is screw-coupled to the gas injected nozzle 23, thereby closing the gas injected nozzle 23.

After closing the gas injection nozzle 23 with the end cap 21 in the above-mentioned manner, the high-pressure gas tank lift 200 with the used high-pressure gas tank lift 200 loaded on the die 201 thereof is lowered to a bottom dead point. Therefore, the high-pressure gas tank clamp 300 is opened from the high-pressure gas tank 10 and the used high-pressure gas tank 10 is removed from the die 201 and replaced with a new high-pressure gas tank (S300).

Thereafter, by the gasket automatic replacement means 500, the used gasket 105*a* is withdrawn and removed from the connector holder 42 and then a new gasket 105 is inserted into the connector holder 42 (S400).

That is, since the gasket 105*a* inserted and used in the connector holder 42 is deformed by the annular protruding band 42*c* and cannot maintain airtightness, the used gasket 105*a* is removed from the connector holder 42 by using the gasket removal cartridge 510 of the gasket automatic replacement means 500 and is stored in the first sleeve 511 of the gasket removal cartridge 510.

To this end, if the docking actuator 504 is driven so as to move the movement member 502 to the connector holder 42 side in a state, in which the first sleeve 511 of the gasket removal cartridge 510 is positioned in line with the connector holder 42, the holding pieces 513 formed on the front end of the gasket removal cartridge 510 are inserted into the cutout parts 42*b* formed at the connector holder 42 and hold the rear end of the used gasket 105*a*, as shown in FIG. 8.

After the holding pieces 513 of the gasket removal cartridge 510 hold the used gasket 105*a* as described above, air is supplied to the inside of the first sleeve 511 such that the first piston 512 moves to the left in the drawing and connected to one surface of the gasket 105*a* to be removed.

However, it would be understood that if the first sleeve 511 of the gasket removal cartridge 510 is filled with use gaskets 105*a*, the gasket 105*a* positioned at the frontmost end comes into close contact with the gasket to be removed.

As described above, if the movement member 502 is returned to its initial position by the docking actuator 504 in a state, in which the holding pieces 513 hold the gasket 105*a* to be removed, the used gasket 105*a* is removed from the connector holder 42 and accommodated in the first sleeve 511.

After removing the used gasket 105*a* from the connector holder 42, a new gasket 105 has to be put into the connector holder 42.

In the process of rotating the holder 501 by driving the fourth actuator 503 in order to insert a new gasket 105 into the connector holder 42, the reflective sensor 507 detects whether the used gasket is present in the connector holder 42 and, if the used gasket 105*a* remains, generates an error and notifies a worker by an alarm means at the same time. However, if the used gasket is not present in the connector holder 42, the gasket insertion cartridge 520 rotates the holder 501 to a position that matches the connector holder 42.

Then, if the docking actuator 504 moves the movement member 502 to the connector holder 42 side as described above so that the front end of the second sleeve 521 is connected to the connector holder 42 and then air is supplied to the gasket insertion cartridge 520, the second piston 522 is moved to the connector holder 42 side such that a new gasket 105 positioned at the frontmost end is inserted into the connector holder 42, wherein the holding protrusion 42*a* is formed on the inlet portion of the connector holder 42 so that the gasket 105 inserted into the connector holder 42 is not separated therefrom even if the gasket insertion cartridge 520 is returned to its initial position.

As described above, after inserting a new gasket 105 into the connector holder 42, the movement member 502 is returned to its initial position by the docking actuator 504 and maintained in a standby state until the next gasket replacement time point.

It is more preferable that the replacement of the gasket 105 as described above is carried out immediately before connecting a new high-pressure gas tank 10 to the connector holder 42 as far as possible.

This is because a replaced new gasket 105 may be contaminated with fine dust and the like when exposed to the atmosphere.

While replacing the gasket from the connector holder 42, if the high-pressure gas tank 10 loaded on the die 201 is clamped by the high-pressure gas tank clamp 300 and then the high-pressure gas tank 10 is lifted up to a top dead point, the safety cap nut ring 24 fixed to the upper portion of the high-pressure gas tank 10 is fitted to the centering guide 72 such that the high-pressure gas tank 10 is centered (S500).

After the high-pressure gas tank 10 is lifted up to the top dead point, the position of the high-pressure gas tank 10 is aligned using the plurality of sensors (not illustrated) built into the auto coupler unit 70 and the roller 303 installed at one end of each gripper 302 of the high-pressure gas tank clamp 300 (S600).

After the alignment of the high-pressure gas tank 10 is completed in the above operation, the end cap 21 is removed from the gas injection nozzle 23 of the high-pressure gas tank 10 and then the gas injection nozzle 23 is connected to the connector holder 42 (S700).

That is, because the first, second, and third actuators 22, 24, 26 of the high-pressure gas tank connection part 40 operate in reverse to the above, the end cap 21 that is screw-coupled to the gas injection nozzle 23 is separated, the separated end cap 21 is stored in the end cap holder 41 and, at the same time, the gas injection nozzle 23, from which the end cap 21 is separated, can be connected to the connector holder 42.

After the gas injection nozzle 23 is connected to the connector holder 42, the valve handle 22 is rotated by the operation of the valve handle unit 110 such that gas can be supplied through the gas pipe 80 (S800).

That is, as shown in FIG. 9 to FIG. 12, the moving piece 57 formed with the rack 58 is moved by the rotation member actuator 53 and the rack drive actuator 55 such that the valve handle gear 114 engaged with the rack 58 is rotated in the counterclockwise direction. Accordingly, the valve handle 22 inserted into the valve handle holder 111 is rotated in the release direction such that the valve 20 is opened. In the above operation, since the spring 93 is wound by the first shaft 91, the valve handle 22 can be locked quickly in the event of an emergency by releasing the locking state of the first latch 59 engaged with the valve handle gear 114.

On the other hand, it would be understood that in the case where one pair of high-pressure gas tank lift 200, one pair of high-pressure gas tank clamps 300, one pair of high-pressure gas tank connection units 100 are installed in the cabinet k, if supplying gas from one high-pressure gas tank 10 through the gas pipe 80, the other one high-pressure gas tank is in a standby state, wherein when the one high-pressure gas tank is replaced due to exhaust of gas, gas can be supplied quickly to the gas line from the other high-pressure gas tank 10.

Although the embodiments of the present invention have been described above with reference to the accompanying drawings, those skilled in the art, to which the present invention belongs, would appreciate that the present invention may be embodied in other specific forms without changing the technical spirit or essential features.

Therefore, the embodiments described above are to be understood in all respects as illustrative and not restrictive, the scope of the present invention described in the above detailed description is represented by the following claims, and all changes or modifications derived from the meaning and scope of the claims and their equivalents should be construed as being included in the scope of the present invention.

What is claimed is:

1. A system for automatically replacing a high-pressure gas tank, comprising:

a high-pressure gas tank lift installed in a cabinet so as to be elevated and including a die to load a high-pressure gas tank thereon;

a high-pressure gas tank clamp for clamping the high-pressure gas tank loaded on the die of the high-pressure gas tank lift and then aligning a position of the high-pressure gas tank;

a high-pressure gas tank connection unit for removing an end cap from the high-pressure gas tank elevated by the high-pressure gas tank lift and then automatically connecting a connector holder to a gas injection nozzle so as to control the flow of a gas; and a control unit installed in the cabinet so as to control the driving of the high-pressure gas tank connection unit, the high-pressure gas tank lift, and the high-pressure gas tank clamp.

2. The system for automatically replacing a high-pressure gas tank according to claim 1, wherein the weight of the high-pressure gas tank loaded on the die of the high-pressure gas tank lift is measured by means of a load cell such that an alarm means notifies a replacement time of the high-pressure gas tank.

3. The system for automatically replacing a high-pressure gas tank according to claim 1, wherein the high-pressure gas tank connection unit includes:

a high-pressure gas tank connection part installed at a lower portion of a main plate so as to detach or attach the end cap or to automatically fasten or disconnect the connector holder to or from the gas injection nozzle of a valve, a valve handle unit installed at an upper portion of the main plate so as to automatically open or close a valve handle that controls the flow of gas; and a movement part installed at one side of the main plate so as to move the main plate up and down.

4. The system for automatically replacing a high-pressure gas tank according to claim 3, wherein the high-pressure gas tank connection part includes:

a second actuator installed on the main plate so as to move a second mounting plate back and forth with respect to an end cap side;

a first actuator installed on the second mounting plate so as to move the first mounting plate in a direction orthogonal to a movement direction of the second mounting plate;

an end cap holder rotatably installed on a vertical plate fixed to the first mounting plate so as to attach or detach the end cap by enclosing the end cap;

a third actuator for rotating the end cap holder so as to allow the end cap to be separated or fastened;

the connector holder installed on the vertical plate so as to be screw-coupled to the gas injection nozzle of the high-pressure gas tank; and first and second gears respectively fixed to shafts of the end cap holder and the connector holder so as to be engaged with each other such that a power of the third actuator is transmitted.

5. The system for automatically replacing a high-pressure gas tank according to claim 3, wherein a valve handle opening and closing unit is further provided on the upper portion of the main plate so as to automatically open or close the valve of the high pressure-gas tank.

6. The system for automatically replacing a high-pressure gas tank according to claim 5, wherein the valve handle opening and closing unit includes:

a rotation member installed on the main plate so as to rotate around a hinge shaft;

a rotation member actuator installed on the main plate, which is positioned on one side of the rotation member, so as to rotate the rotation member;

a third elastic member installed between the rotation member and the rotation member actuator;

one pair of rack drive actuators fixed and mounted to the rotation member;

a moving piece driven by the rack drive actuators so as to move back and forth through a guide of a guide rod;

a rack fixed to the moving piece and engaged with a valve handle gear; and a first latch to be held by the valve handle gear so as to prevent the valve handle gear from rotating in reverse when winding a spring that has one end fixed to a first shaft and another end fixed to a fixing pin.

7. The system for automatically replacing a high-pressure gas tank according to claim 5, wherein the valve handle opening and closing unit includes a spring winding unit.

8. The system for automatically replacing a high-pressure gas tank according to claim 7, wherein the spring winding unit includes:

a first shaft installed in the center of the valve handle unit;

a fixing pin installed so as to be positioned inside the valve handle unit;

a spring having one end fixed to the fixing pin and another end fixed to the first shaft so as to be wound as the first shaft is rotated in a direction, in which the valve handle is opened;

a spring drive gear fixed to the first shaft so as to be positioned on an upper portion of a valve handle gear;

a second shaft rotatably installed on the main plate;

an amplification gear fixed to the second shaft so as to amplify the rotational speed of the second shaft;

a link fixed to the second shaft;

a planetary gear installed in engagement with the amplification gear at one end of the link so as to be engaged with or disengaged from the spring drive gear;

a second latch wheel fixed to the second shaft;

a second latch engaged with the second latch wheel so as to prevent the second shaft from rotating in reverse when a one-way clutch is restored;

a second elastic member to which one end of the second latch is connected;

a planetary gear drive actuator, of which a rod is connected to the other one end of the link so as to rotate the link; and a spring winding actuator for rotating the second shaft so as to enable the spring to be wound around the first shaft.

9. The system for automatically replacing a high-pressure gas tank according to claim 3, wherein the high-pressure gas tank connection unit is further provided with a gasket automatic replacement means for automatically inserting a gasket into the connector holder or automatically removing a used gasket.

10. The system for automatically replacing a high-pressure gas tank according to claim 9, wherein the gasket automatic replacement means includes:

a holder installed so as to be positioned at one side of the connector holder;

a movement member rotatably installed in the holder;

a fourth actuator installed in the holder so as to rotate the movement member;

a docking actuator for enabling the movement member move back and forth from the holder to the connector holder side;

a gasket removal cartridge installed in the movement member so as to automatically remove a used gasket from the connector holder and to accommodate the used gasket in turn; and a gasket insertion cartridge installed at the upper portion or the lower portion of the gasket removal cartridge so as to insert a new gasket, which is accommodated in the gasket insertion cartridge, into the connector holder.

11. The system for automatically replacing a high-pressure gas tank according to claim 10, wherein a reflective sensor is installed on the movement member positioned between the gasket removal cartridge and the gasket insertion cartridge and can detect whether any used gasket remains in the connector holder.

12. A method for automatically replacing a high-pressure gas tank, comprising:

closing a valve handle by means of a valve handle unit if a control unit detects a weight of a high-pressure gas tank and determines a replacement time of a high-pressure gas tank;

separating a connector holder connected to a gas injection nozzle by means of a high-pressure gas tank connection unit, and then closing the gas injection nozzle with an end cap;

lowering the high-pressure gas tank lift to a bottom dead point and then opening a high-pressure gas tank clamp from the high-pressure gas tank and removing the used high-pressure gas tank from a die;

placing a new high-pressure gas tank on the die and then, after clamping the new high-pressure gas tank with the high-pressure gas tank clamp, lifting the high-pressure gas tank to a top dead center;

aligning a position of the high-pressure gas tank by using an auto coupler unit and the high-pressure gas tank clamp after the high-pressure gas tank is lifted up to the top dead center;

removing the end cap from the gas injection nozzle of the high-pressure gas tank and then connecting the gas injection nozzle to the connector holder, after the alignment of the high-pressure gas tank is finished; and supplying gas through a gas pipe by rotating the valve handle by the operation of the valve handle unit.

13. The method for automatically replacing a high-pressure gas tank according to claim 12, wherein before fastening the gas injection nozzle of the new high-pressure gas tank to the connector holder, a step is further carried out for inserting a new gasket after removing the used gasket from the connector holder.

14. The method for automatically replacing a high-pressure gas tank according to claim 12, wherein when a gas leak is detected while supplying gas from the high-pressure gas tank through the gas pipe, the valve handle of the high-pressure gas tank is automatically closed by the drive of a spring winding unit.

15. The method for automatically replacing a high-pressure gas tank according to claim 12, wherein in the case where each one pair of high-pressure gas tank lifts, each one pair of high-pressure gas tank clamps, and each one pair of high-pressure gas tank connection units are installed in a cabinet, gas is supplied from one high-pressure gas tank through the gas pipe and then supplied to a process line from the other one high-pressure gas tank, which is in a standby state, when the one high-pressure gas tank is replaced due to the exhaustion of the gas.

* * * * *